US007810898B2

(12) United States Patent
Furukawa et al.

(10) Patent No.: US 7,810,898 B2
(45) Date of Patent: Oct. 12, 2010

(54) LIQUID EJECTION APPARATUS AND MAINTENANCE METHOD FOR LIQUID EJECTION HEAD

(75) Inventors: Gentaro Furukawa, Kanagawa-ken (JP); Toshiya Kojima, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 845 days.

(21) Appl. No.: 11/727,605

(22) Filed: Mar. 27, 2007

(65) Prior Publication Data

US 2007/0229588 A1 Oct. 4, 2007

(30) Foreign Application Priority Data

Mar. 28, 2006 (JP) ..... 2006-089288

(51) Int. Cl.
*B41J 2/015* (2006.01)

(52) U.S. Cl. ..... 347/21; 347/33; 347/28; 347/92

(58) Field of Classification Search ..... 347/21–23, 347/29–36, 40, 42, 68, 70–72, 92

See application file for complete search history.

(56) References Cited

U.S. PATENT DOCUMENTS 6,682,165 B2 * 1/2004 Yearout ..... 347/28

FOREIGN PATENT DOCUMENTS

JP 2005-144737 A 6/2005

* cited by examiner

*Primary Examiner*—Juanita D Stephens
(74) *Attorney, Agent, or Firm*—Birch, Stewart, Kolasch & Birch, LLP

(57) ABSTRACT

The liquid ejection apparatus includes: a liquid ejection head having a nozzle forming surface formed with nozzles from which a first liquid is ejected; a wiping processing device which carries out a wiping process of the nozzle forming surface of the liquid ejection head; and a movement device which causes relative movement between the liquid ejection head and the wiping processing device, wherein the wiping processing device includes: a wiping member which wipes the nozzle forming surface of the liquid ejection head; and a second liquid supply device which supplies a second liquid which has undergone a deaeration process, to a vicinity of a contact region between the wiping member and the nozzle forming surface of the liquid ejection head, on a side of forward travel of the wiping member, in the wiping process.

10 Claims, 19 Drawing Sheets

LIQUID EJECTION APPARATUS AND MAINTENANCE METHOD FOR LIQUID EJECTION HEAD

BACKGROUND OF THE INVENTION

1. Field of the Invention

The present invention relates to a liquid ejection apparatus and a maintenance method for a liquid ejection head, and more particularly, relates to liquid ejection head maintenance technology for an inkjet recording apparatus which forms an image on a medium by ejecting ink from a nozzle.

2. Description of the Related Art

In an inkjet recording apparatus which forms images on a recording medium by moving a recording medium and a head relatively to each other, if foreign matter such as ink or paper dust adheres to the nozzle forming surface (ejection surface) of the head or the interior of the nozzles (ejection holes), then it becomes difficult to sustain prescribed ejection characteristics and this leads to degradation of the quality of the recorded image. In order to solve problems of this kind, maintenance is carried out to remove foreign matter from the nozzle forming surface and the interiors of the nozzles.

Japanese Patent Application Publication No. 2005-144737 discloses an invention relating to an inkjet printer in which ink blockages in the ejection holes are avoided by performing a removal operation of spraying a cleaning liquid onto the ejection surface of the recording head, wiping the ejection surface with a blade and then ejecting ink from the ejection holes.

However, in a maintenance method which removes foreign matter on the nozzle forming surface by wiping the nozzle forming surface with a blade, air bubbles are incorporated inside the nozzles by the wiping action of the blade over the nozzle surface. If air bubbles are incorporated inside the nozzles, then during ink ejection for image formation, effects caused by the ejection pressure are absorbed by the air bubbles and this gives rise to ejection abnormalities, such as ejection failures, deviation of the ejection direction, and reduction in the volume of ejected liquid droplets. As one method for avoiding ejection abnormalities caused by incorporation of air bubbles in this way, purging (preliminary ejection) is carried out after wiping by means of a blade; however, a large volume of ink is required to be ejected to remove air bubbles from the interior of the nozzles, and therefore the ink consumption volume increases.

In the invention disclosed in Japanese Patent Application Publication No. 2005-144737, when the cleaning liquid is sprayed onto the ejection surface, the cleaning liquid directly infiltrates into the meniscus and therefore there is a possibility that air bubbles may become incorporated. Furthermore, since the ejection surface of the recording head is wiped by a blade after applying the cleaning liquid onto the ejection surface, then the deaeration level in the vicinity of the meniscus declines during the period from the spraying of the cleaning liquid until the wiping action.

SUMMARY OF THE INVENTION

The present invention is contrived in view of the aforementioned circumstances, an object thereof being to provide a liquid ejection apparatus and a maintenance method for a liquid ejection head which avoid incorporation of air bubbles into the nozzles and reliably remove foreign matter on the nozzle forming surface and inside the nozzles.

The present invention is directed to a liquid ejection apparatus comprising: a liquid ejection head having a nozzle forming surface formed with nozzles from which a first liquid is ejected; a wiping processing device which carries out a wiping process of the nozzle forming surface of the liquid ejection head; and a movement device which causes relative movement between the liquid ejection head and the wiping processing device, wherein the wiping processing device includes: a wiping member which wipes the nozzle forming surface of the liquid ejection head; and a second liquid supply device which supplies a second liquid which has undergone a deaeration process, to a vicinity of a contact region between the wiping member and the nozzle forming surface of the liquid ejection head, on a side of forward travel of the wiping member, in the wiping process.

In this aspect of the present invention, since wiping is carried out by means of the wiping member while the second liquid is supplied to the nozzle forming surface of the liquid ejection head, then incorporation of air bubbles into the nozzles is suppressed. Moreover, even if air bubbles become incorporated into the nozzles, it is possible to make these air bubbles dissolve into the second liquid which has undergone the prescribed deaeration process.

The volume of second liquid supplied is a volume of which the second liquid is able to cover at least one nozzle. There is a mode in which an ejection control device is provided, which controls ink ejection so as to eject ink in the nozzle arrangement sequence in the main scanning direction, in such a manner that the ink is ejected in sequence from the nozzles on the downstream side in terms of the scanning direction, in synchronism with the scanning (movement) of the recording head in the main scanning direction.

There is a mode where the liquid ejection head comprises nozzles for ejecting a first liquid, pressure chambers which accommodate the first liquid to be ejected from the nozzles, and pressurization devices which pressurize the liquid inside the pressure chambers. Moreover, in a case where a plurality of nozzles (pressure chambers) are provided, there is a mode where an ink supply channel (a common liquid chamber) is provided for distributing and supplying ink to the pressure chambers.

The liquid ejection head may be a full line head having a plurality of nozzles arranged through the length of at least one edge of the ejection receiving medium (medium which receives the first liquid). If the wiping process is carried out in a full line head of this kind, then it is possible to move the liquid ejection head and the wiping processing device (wiping member), relatively to each other, in a direction substantially parallel to the breadthwise direction of the liquid ejection head, or to move the liquid ejection head and the wiping processing device (wiping member) relatively to each other, in a direction substantially parallel to the lengthwise direction of the liquid ejection head.

The second liquid supply device includes a fine aperture (nozzle) from which the second liquid ejected (spouted). One or a plurality of these fine holes may be provided.

The amount of dissolved gas in the second liquid is less than the amount of dissolved gas in the first liquid. Furthermore, desirably, the second liquid includes at least a portion of the components of the first liquid. A more desirable mode is one in which the second liquid and the first liquid have the same composition. In a case where the first liquid and the second liquid have the same composition, it is possible to adopt a mode where the accommodating unit (supply tank) which accommodates the first liquid is combined with the accommodating unit which accommodates the second liquid.

Preferably, the liquid ejection apparatus further comprises: a recovery device which recovers the second liquid which has been supplied to the vicinity of the contact region between the wiping member and the nozzle forming surface; a deaeration device which carries out a deaeration process of the second liquid which has been recovered by the recovery device; and a liquid feeding device which sends the second liquid which has undergone the deaeration process by the deaeration device, to the second liquid supply device.

In this aspect of the present invention, by recovering the second liquid used in the wiping process and carrying out the deaeration process of the recovered second liquid, it is possible to reuse the used second liquid, thus contributing to a reduction of the consumption of the second liquid.

A desirable mode is one in which a foreign matter removing device which removes foreign matter included in the used second liquid is provided. The foreign matter removing device may be a filter, or the like.

The liquid feeding device which sends the second liquid may include a flow channel member such as a tube or channel, and a pressurization device such as a pump. A desirable mode is one where the flow channel member uses a member having prescribed air-sealing properties (for example, a metal tube).

Preferably, the liquid ejection apparatus further comprises: pressure chambers which are connected to the nozzles and accommodate the first liquid that is to be ejected from the nozzles; pressurization devices which pressurize the first liquid in the pressure chambers; a drive signal application device which applies drive signals to the pressurization devices; and a control device which controls the drive signal application device in the wiping process so as to apply the drive signals to the pressurization devices, in such a manner that the first liquid in the pressure chambers is pressurized by the pressurization devices so as not to eject the first liquid from the nozzles.

In this aspect of the present invention, foreign matter which is present in the vicinity of the nozzles (meniscuses) can be removed, and it is also possible to reduce the amount of dissolved gas in the first liquid by making the second liquid enter inside the nozzles and causing the gas dissolved in the first liquid to become dissolved in the second liquid.

Preferably, the wiping member has a structure in which the second liquid is supplied to the nozzle forming surface of the liquid ejection head.

In this aspect of the present invention, it is possible to form a pool of the second liquid in the wiping process region, without impairing the level of deaeration of the second liquid (without increasing the amount of dissolved gas), and hence the deaeration capacity during the wiping process (the capacity for making the dissolved gas in the first liquid dissolve into the second liquid) is improved.

The modes of providing a structure which supplies the second liquid to the wiping member include a mode in which a fine pore(s) (nozzle(s)) is provided on the surface of the wiping member which makes contact with the nozzle forming surface of the liquid ejection head.

Preferably, the wiping member includes a regulation member which regulates a volume of the second liquid supplied to the vicinity of the contact region between the wiping member and the nozzle forming surface.

In this aspect of the present invention, it is possible to form a pool of the second liquid on the nozzle forming surface of the liquid ejection head uniformly, and wiping residue (wiping non-uniformities) caused by non-uniformity of the liquid pool is prevented.

There is a mode in which absorbing members which absorb the second liquid is provided at either end portion of the wiping member in terms of the breadthwise direction (a direction substantially perpendicular to the movement direction during the wiping process), and there is a mode in which a pool is formed between two wiping members.

Preferably, the liquid ejection apparatus further comprises: a position determination device which determines a position of the wiping processing device; an ejection abnormality nozzle determination device which determines, of the nozzles, a nozzle suffering an ejection abnormality; and a control device which controls the wiping processing device and the movement device in such a manner that the wiping process is carried out by the wiping processing device with respect to the nozzle suffering the ejection abnormality determined by the ejection abnormality nozzle determination device.

In this aspect of the present invention, the wiping process is carried out selectively with respect to the ejection abnormality nozzle and the region in the vicinity of same, and this contributes to shortening the restoration process time with respect to the ejection abnormality nozzle and reducing the consumption of the second liquid. Furthermore, improved ejection efficiency can be expected and power savings can be achieved in the apparatus as a whole.

In a mode where the wiping process is carried out with respect to a portion of the nozzle forming surface of the liquid ejection head, the wiping member used has a smaller width than the width of the nozzle surface of the liquid ejection head.

Preferably, the liquid ejection head is a line head which corresponds to a width of an ejection receiving medium which receives the first liquid ejected from the liquid ejection head; the wiping member is disposed in an oblique direction forming an angle of $\alpha$ (where $0° < \alpha < 90°$) with respect to a breadthwise direction of the liquid ejection head, in the wiping process; the movement device is capable of switching a direction of the relative movement between the liquid ejection head and the wiping processing device, between the breadthwise direction of the liquid ejection head and a lengthwise direction of the liquid ejection head; and the control device controls the wiping processing device and the movement device in such a manner that the direction of the relative movement between the liquid ejection head and the wiping processing device is selectively switched.

In this aspect of the present invention, when a wiping process is carried out with respect to a line head, it is possible to shorten the wiping process time if the wiping processing device (wiping member) is moved in the breadthwise direction of the liquid ejection head. Furthermore, if the wiping processing device is moved in the lengthwise direction of the liquid ejection head, then it is possible to carry out a wiping process on a plurality of regions (broad region), in a single wiping operation.

In particular, if this aspect of the present invention is combined with the position determination device, the ejection abnormality nozzle determination device and the control device mentioned above, then it is possible to selectively switch the direction of the wiping process, in accordance with the size of the region in which an ejection abnormality nozzle (s) is present, and therefore improvements in the efficiency of the wiping process can be expected.

The present invention is also directed to a maintenance method for a liquid ejection head having a nozzle forming surface formed with nozzles from which a first liquid is ejected, including the steps of: disposing a wiping processing device including a wiping member, at a prescribed position; and causing relative movement between the liquid ejection head and the wiping processing device in such a manner that a wiping process in which the wiping member wipes the nozzle forming surface of the liquid ejection head is carried out, while a second liquid which has undergone a deaeration process is supplied to a vicinity of a contact region between the wiping member and the nozzle forming surface of the liquid ejection head.

According to the present invention, since wiping is carried out by means of the wiping member while the second liquid is supplied to the nozzle forming surface of the liquid ejection head, then incorporation of air bubbles into the nozzles is suppressed, and even if air bubbles become incorporated into the nozzles, it is possible to make these air bubbles dissolve into the second liquid which has undergone a prescribed deaeration process.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
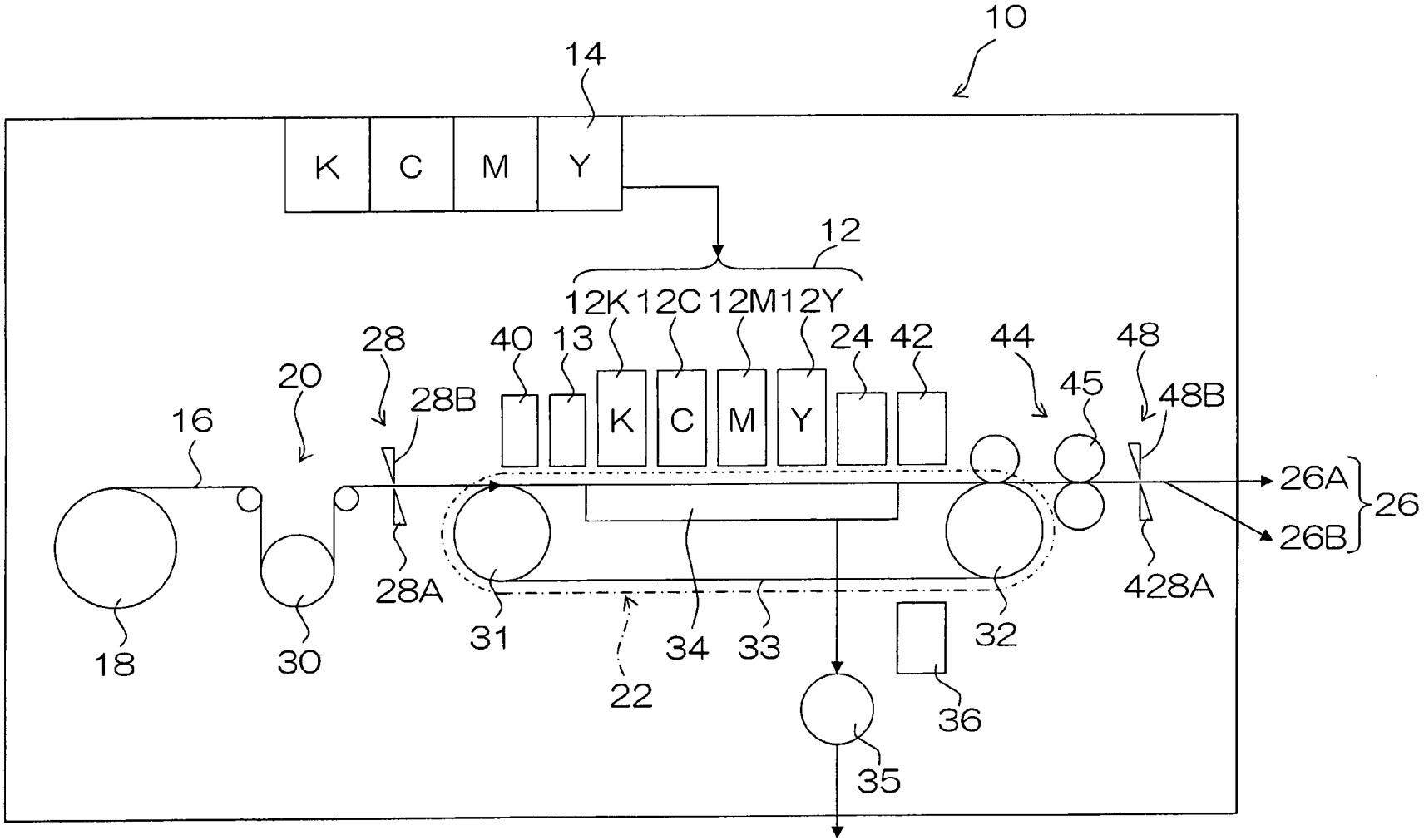
FIG. 1 is a general schematic drawing of an inkjet recording apparatus relating to an embodiment of the present invention.

FIG. 1 is a diagram of the general composition of an inkjet recording apparatus relating to an embodiment of the present invention. As shown in FIG. 1, the inkjet recording apparatus 10 comprises: a print unit 12 having a plurality of heads 12K, 12C, 12M and 12Y for ink (a first liquid) colors of black (K), cyan (C), magenta (M), and yellow (Y), respectively; a wiping processing unit 13 (wiping processing device) for removing the ink or paper powder deposited on the nozzle forming surfaces (not shown in FIG. 1 but shown as a nozzle forming surface 51A in FIGS. 4A and 4B) of the heads 12K, 12C, 12M and 12Y; an ink storing and loading unit 14 for storing inks of K, C, M and Y to be supplied to the heads 12K, 12C, 12M and 12Y; a paper supply unit 18 for supplying recording paper 16 (ejection receiving medium); a decurling unit 20 for removing curl in the recording paper 16; a suction belt conveyance unit 22 disposed facing the nozzle forming surface of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

Although not shown in FIG. 1, the print unit 12 in FIG. 1 is constituted in such a manner that it can be moved between a printing position and a withdrawal position (in other words, switched between a printing state and a withdrawn state). The printing position is the position at which ink ejection is performed from the heads 12K, 12C, 12M and 12Y in order to form an image on the recording paper 16 by ejecting inks of respective colors. When the print unit 12 is located in the printing position, then the clearance between the recording paper 16 and the nozzle forming surfaces of the heads 12K, 12C, 12M and 12Y is approximately several mm. The state shown in FIG. 1 is one where the print unit 12 is located in the printing position, and this state is a printing state.

The withdrawal position is a position in which the print unit 12 has been withdrawn from the printing position described above. The print unit 12 is moved to this withdrawal position when maintenance processing, such as purging and wiping, is carried out or when printing is not performed (e.g., when printing has halted or when the apparatus is at standby).

For example, when a wiping process is carried out, the print unit 12 is moved to the withdrawal position, and a wiping processing unit 13 is moved to a prescribed position in the vicinity of the nozzle forming surfaces of the heads 12K, 12C, 12M and 12Y, and the wiping processing unit 13 carries out a wiping process. Moreover, when purging (preliminary ejection) is carried out, the print unit 12 is moved to the withdrawal position, a cap 64 (described hereinafter) is abutted against the nozzle forming surfaces of the heads 12K, 12C, 12M and 12Y, and purging of the heads 12K, 12C, 12M and 12Y is carried out. The state where the print unit 12 is moved to the withdrawal position to carry out maintenance processing in this way is called the maintenance state.

When the apparatus continues in a non-printing state for a prescribed period of time or more, then the print unit 12 is moved to the withdrawal position and the cap is abutted against the nozzle forming surfaces of the heads 12K, 12C, 12M and 12Y, thereby preventing drying (solidification) of ink inside the nozzles. This state where the print unit 12 has been moved to the withdrawal position and the nozzles of the heads 12K, 12C, 12M and 12Y are protected by means of the cap, is called a rest state.

To give embodiments of the withdrawal position described above, there is a mode where the withdrawal position is set in the opposite direction of the recording paper 16 with respect to the printing position (set to a position vertically above the recording paper 16), or a mode where the withdrawal position is set to a position in a horizontal direction parallel to the image forming surface (recording surface) of the recording paper 16.

In other words, the print unit 12 is composed in such a manner that it can be moved between the printing position and the withdrawal position by means of a print unit movement mechanism (not illustrated). It is also possible to adopt a mode in which the print unit 12 is located in a fixed position, and the wiping processing unit 13, the suction belt conveyance unit 22 and the cap (described below; reference numeral 64 in FIG. 5) are moved with respect to the print unit 12. If the print unit 12 is located in a fixed position, then the printing state is a state where the suction belt conveyance unit 22 is positioned directly below the print unit 12 (the state shown in FIG. 1), and the withdrawn state is a state where maintenance members, such as a wiping processing unit 13, cap, and the like, are positioned directly below the print unit 12. The withdrawn state includes a maintenance state, in which wiping, purging, suctioning, or the like, is carried out, and a rest state in which the ink inside the nozzles is protected by attaching the cap to the nozzle forming surface.

FIG. 1 shows a schematic view in which the wiping processing unit 13 is disposed on the upstream side of the print unit 12 in terms of the paper feed direction (the conveyance direction of the recording paper) when the inkjet recording apparatus 10 is in the printing state; however, it is also possible to dispose the wiping processing unit 13 on the downstream side of the print unit 12 in terms of the paper feed direction. Furthermore, it is also possible to dispose the wiping processing unit 13 in a direction perpendicular to the paper feed direction, with respect to the print unit 12.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle forming surface of the print unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle forming surface of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1. The details of the belt 33 will be described later.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
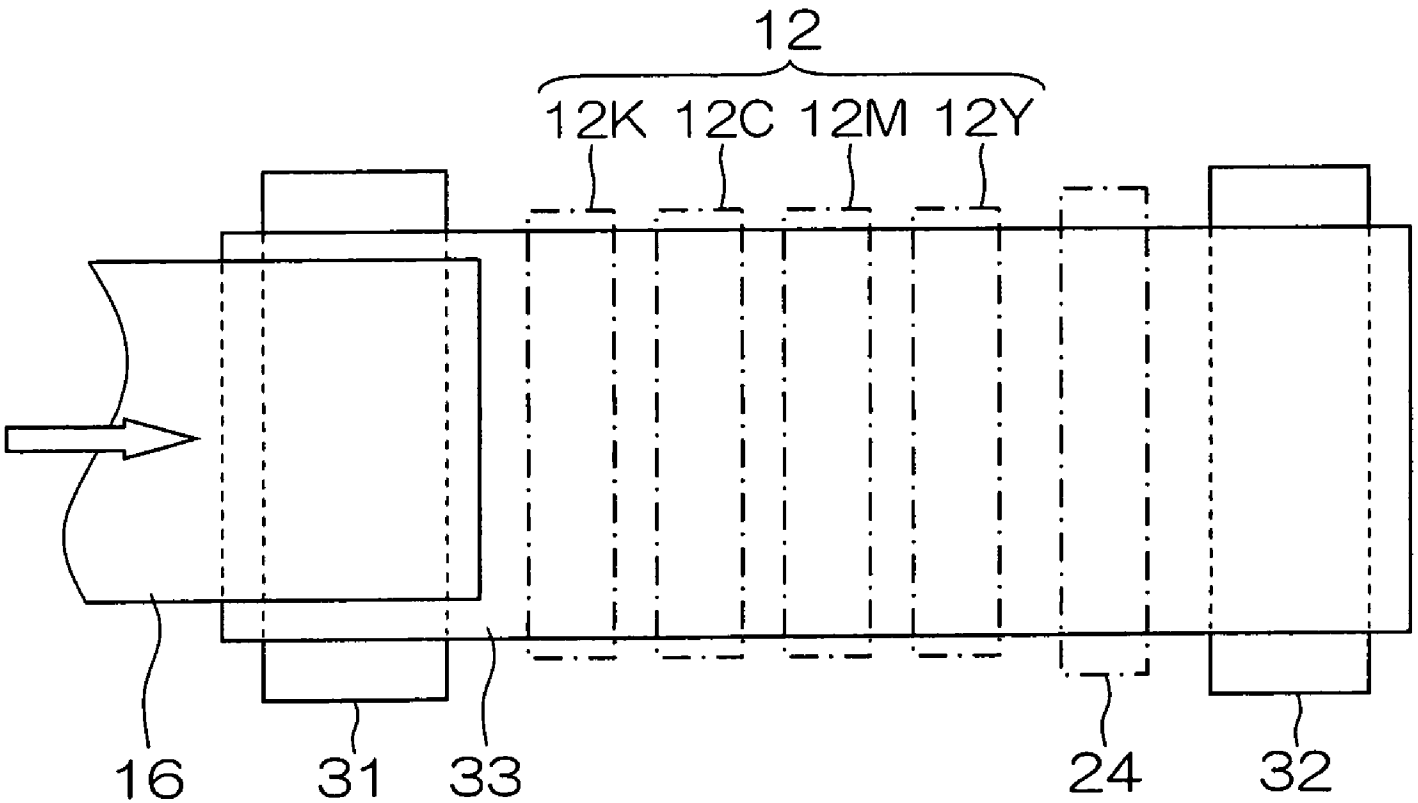
FIG. 2 is a plan view of the principal part of the peripheral printing region of the inkjet recording apparatus illustrated in FIG. 1.

The print unit 12 is a so-called full-line head in which a line head having a length corresponding to the maximum paper width is disposed in a perpendicular direction with respect to the paper feed direction (namely, disposed in the main scanning direction) (see FIG. 2, which does not depict the elements in the periphery of the print unit 12, such as the wiping processing unit 13, the heating fan 40, and the like, shown in FIG. 1). An embodiment of the detailed structure is described below, but each of the heads 12K, 12C, 12M and 12Y is constituted by a line head, in which a plurality of nozzles (ink ejection ports) are arranged through a length that exceeds at least one side of the maximum-size recording paper 16 intended for use in the inkjet recording apparatus 10, as shown in FIG. 2.

Heads 12K, 12C, 12M and 12Y corresponding to respective ink colors are disposed in the order, black (K), cyan (C), magenta (M) and yellow (Y), from the upstream side, following the paper conveyance direction described above (the sub-scanning direction). A color print can be formed on the recording paper 16 by ejecting the inks from the heads 12K, 12C, 12M and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective heads 12K, 12C, 12M and 12Y, and the respective tanks are connected to the heads 12K, 12C, 12M and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles from the recorded images read by the image sensor.

The print determination unit 24 of the present embodiment is configured with at least a line sensor having rows of photoelectric transducing elements with a width that is greater than the ink-droplet ejection width (image recording width) of the heads 12K, 12C, 12M and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern (or an actual image) printed by the heads 12K, 12C, 12M and 12Y of the respective colors, and carries out ejection abnormality determination for each head. The ejection abnormality determination includes determining the presence of ejection, measuring the dot size, measuring the dot depositing positions, and the like. The print determination unit 24 is provided with a light source (not illustrated) to illuminate the deposited dots.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

In cases in which printing is performed using dye-based ink on a porous paper, blocking the pores of the paper by the application of pressure prevents the ink from coming into contact with ozone and other substances that cause dye molecules to break down, and therefore has the effect of increasing the durability of the image.

The printed matter generated in this manner is outputted from the paper output unit 26. The target print (i.e., an actual image obtained by printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders. Incidentally, a reference numeral 26B indicates a test print output unit.

Explanation of the Print Head

Next, the structure of the head 50 will be described. The heads 12K, 12C, 12M and 12Y of the respective ink colors have the same structure, and a reference numeral 50 is hereinafter designated to any of the print heads.

Figure 3A:
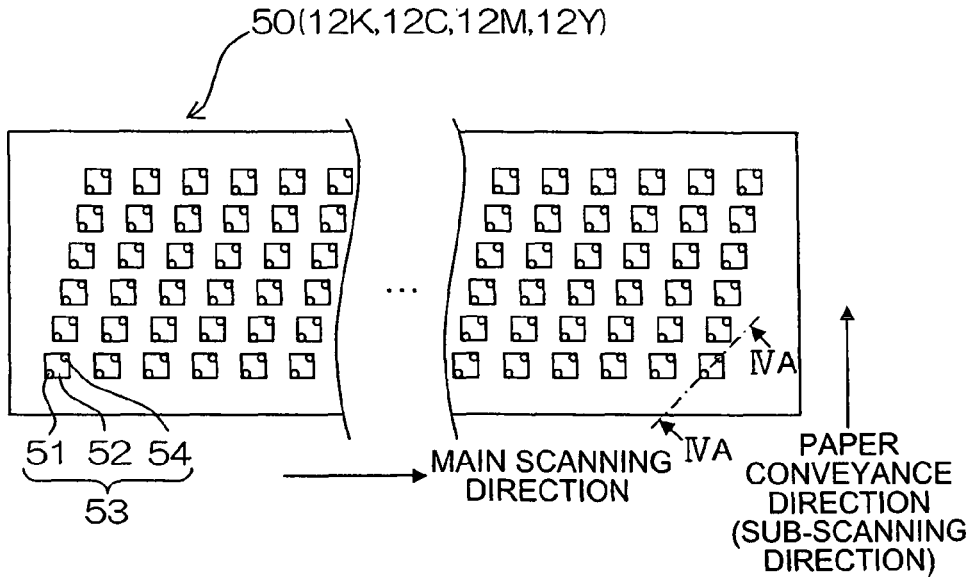
FIGS. 3A to 3C are plan view perspective diagrams showing embodiments of the composition of a print head.
Figure 3B:
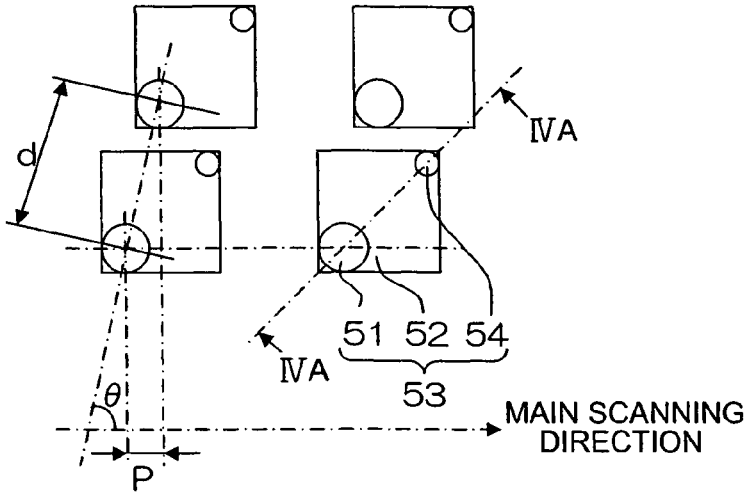
Figure 3C:
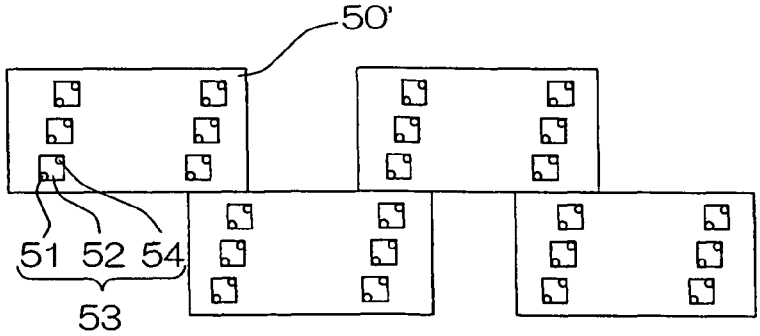

FIG. 3A is a plan view perspective diagram showing an embodiment of the structure of a head 50; FIG. 3B is an enlarged view of a portion of same; and FIG. 3C is a plan view perspective diagram showing a further embodiment of the structure of a head 50. In order to achieve a high density of the dot pitch printed onto the surface of the recording medium, it is necessary to achieve a high density of the nozzle pitch in the print head 50. As shown in FIGS. 3A to 4C, the print head 50 in the present embodiment has a structure in which a plurality of ink chamber units 53 including nozzles 51 for ejecting ink droplets and pressure chambers 52 connecting to the nozzles 51 are disposed in the form of a staggered matrix, and the effective nozzle pitch is thereby made small.

More specifically, as shown in FIGS. 3A and 3B, the head 50 according to the present embodiment is a full-line head having one or more nozzle rows in which a plurality of nozzles 51 for ejecting ink are arranged along a length corresponding to the entire width of the recording medium in a direction substantially perpendicular to the conveyance direction of the recording medium.

Moreover, as shown in FIG. 3C, it is also possible to use respective print heads 50' of nozzles arranged to a short length in a two-dimensional fashion, and to join same together in a zigzag arrangement, whereby a length corresponding to the full width of the print medium is achieved, and it is also possible to join short heads 50' together in a linear arrangement.

Figure 4A:
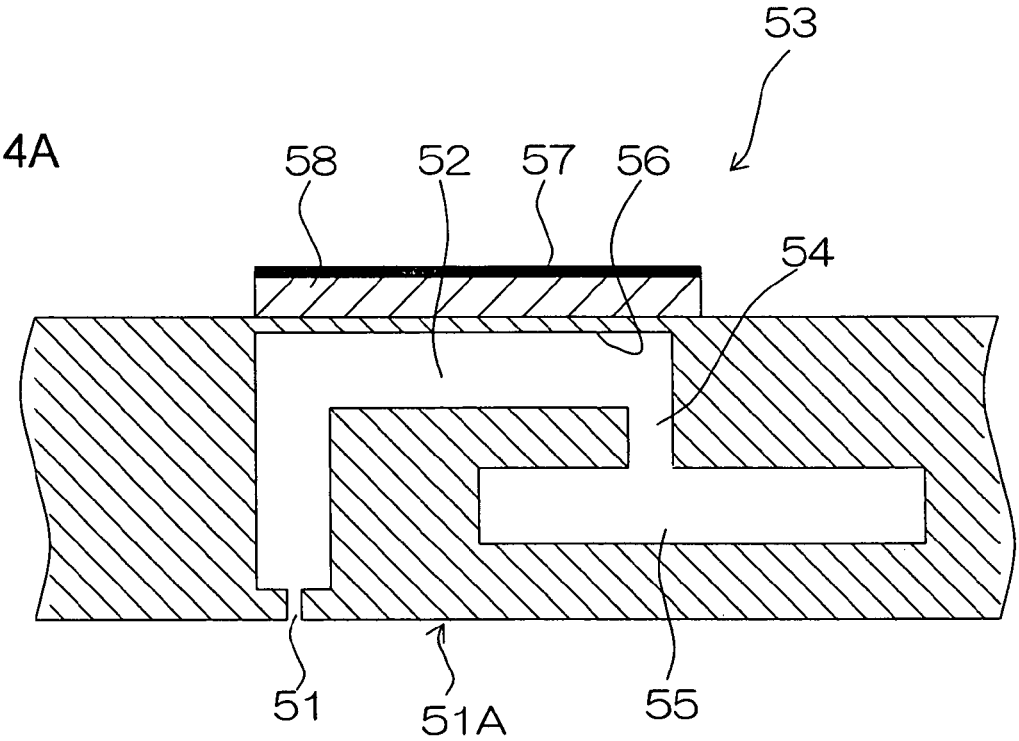
FIG. 4A is a cross-sectional views along line IV A-IV A in FIGS. 3A and 3B.
Figure 4B:
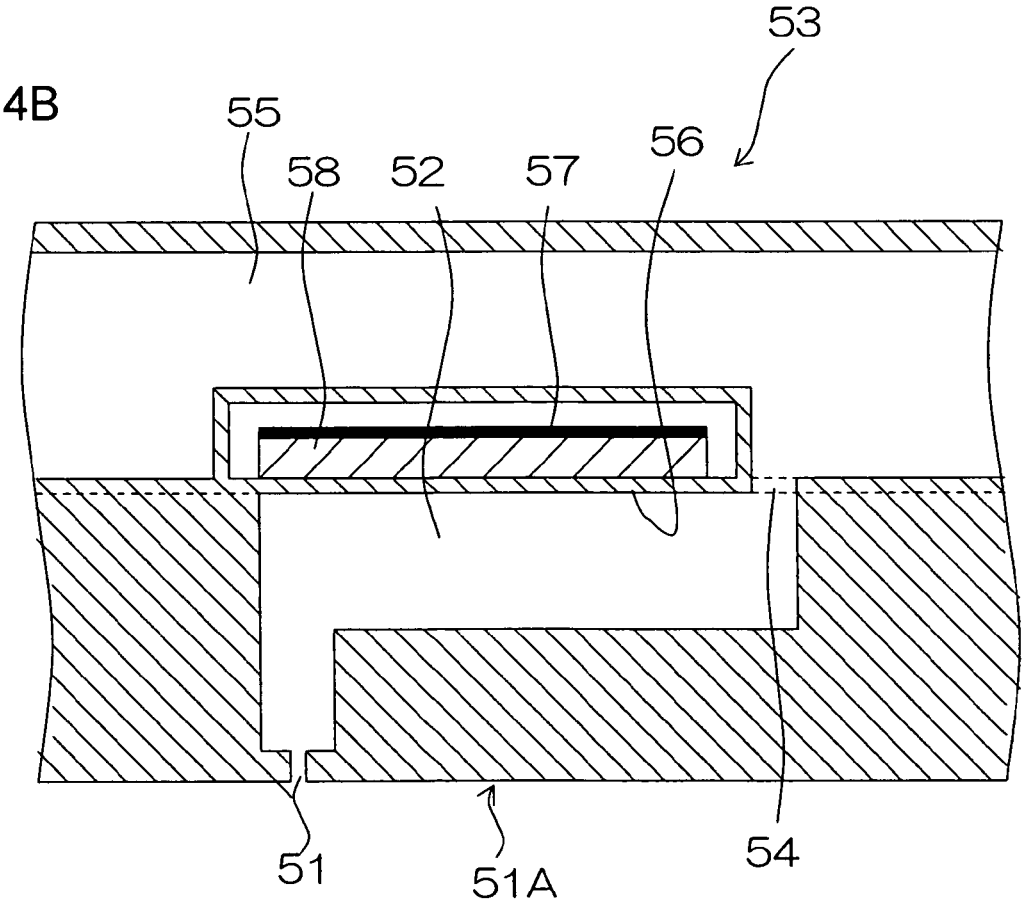
FIG. 4B is a cross-sectional diagram showing a further mode of the structure shown in FIG. 4A.

FIG. 4A is a cross-sectional diagram showing the three-dimensional composition of an ink chamber unit 53 (a cross-sectional view along line IV A-IV A in FIG. 3A), and FIG. 4B is a cross-sectional diagram showing a further mode of the structure of the ink chamber unit 53 shown in FIG. 4A.

The pressure chamber 52 provided corresponding to each of the nozzles 51 is approximately square-shaped in plan view, and a nozzle 51 and a supply port 54 are provided respectively at either corner of a diagonal of the pressure chamber 52. Each pressure chamber 52 is connected via the supply port 54 to a common flow channel 55.

A piezoelectric actuator 58 (piezo element) provided with an individual electrode 57 is joined to a pressure plate 56 which forms the upper face of the pressure chamber 52, and the piezoelectric actuator 58 is deformed when a drive voltage is supplied to the individual electrode 57, thereby causing ink to be ejected from the nozzle 51. When ink is ejected, new ink is supplied to the pressure chamber 52 from the common flow passage 55, via the supply port 54.

As shown in FIG. 3A, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure in which a plurality of ink chamber units 53 are arranged at a uniform pitch d in a direction having an angle $\theta$ with respect to the main scanning direction, the pitch P of the nozzles projected so as to align in the main scanning direction is $d \times \cos\theta$.

More specifically, the arrangement can be treated equivalently to one in which the respective nozzles 51 are arranged in a linear fashion at uniform pitch P, in the main scanning direction. By means of this composition, it is possible to achieve a nozzle composition of high density, in which the nozzle columns projected to align in the main scanning direction reach a total of 2400 per inch (2400 nozzles per inch). Below, in order to facilitate the description, it is supposed that the nozzles 51 are arranged in a linear fashion at a uniform pitch (P), in the longitudinal direction of the head (main scanning direction).

In a full-line head comprising rows of nozzles corresponding to the entire width of the paper, the "main scanning" is defined as printing a line formed of a row of dots, or a line formed of a plurality of rows of dots in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIGS. 3A to 3C are driven, the main scanning according to the above-described (3) is preferred.

On the other hand, "sub-scanning" is defined as to repeatedly perform printing of a line formed of a row of dots, or a line formed of a plurality of rows of dots formed by the main scanning, while moving the full-line head and the recording paper relatively to each other.

In other words, "main scanning" is the action of driving the nozzles so as to print a line constituted by one row of dots, or a plurality of rows of dots, in the breadthwise direction of the paper, and "sub-scanning" is the action of repeating the printing of a line constituted by one row of dots or a plurality of rows of dots formed by main scanning.

When implementing the present invention, the arrangement of the nozzles is not limited to that of the embodiment illustrated. Moreover, the present embodiment adopts a method in which ink droplets are ejected by the deformation of a piezoelectric actuator 58, typically a piezo element. In implementing the present invention, another actuator, such as a piezo element, can be used as the piezoelectric actuator 58.

FIG. 4B shows a rear surface flow channel structure in which a common liquid chamber 55 is disposed on the rear surface, on the opposite side of the pressure chambers 52 from the direction of ink ejection (i.e., the common liquid chamber 55 is disposed across the pressure plate 56 from the pressure chambers 52). In the rear surface flow channel structure shown in FIG. 4B, since each pressure chamber 52 and the common liquid chamber 55 are connected by means of a supply port 54 formed in the pressure plate 56, then the fluid resistance on the ink supply side becomes smaller and the refilling efficiency can be increased greatly in comparison with the structure shown in FIG. 4A. The rear surface flow channel structure shown in FIG. 4B is able to sustain a high ejection frequency, even when a high-viscosity ink which has a higher viscosity than normal ink is used.

In the rear surface flow channel structure shown in FIG. 4B, a protective member (cover) is provided for each piezoelectric actuator 58 in order to prevent the ink inside the common flow chamber 55 from coming into contact with the piezoelectric actuator 58. Furthermore, since the pressure plate 56 also serves as a common electrode of the piezoelectric actuators 58, then an insulation treatment of the portions of the pressure plate 56 which make contact with the ink is carried out.

Explanation of an Ink Supply System

Figure 5:
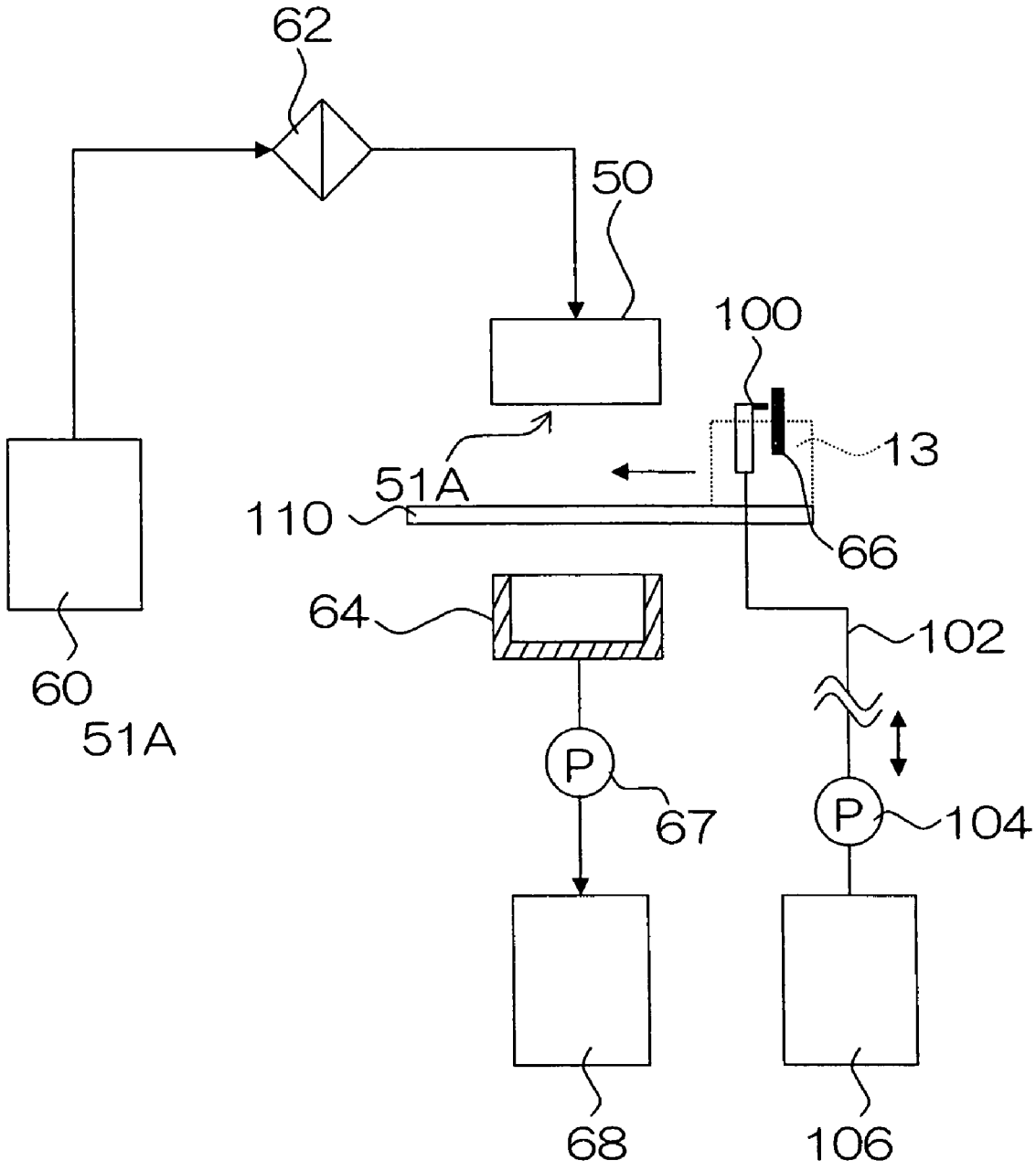
FIG. 5 is an approximate diagram showing the composition of an ink supply unit and a deaerated liquid supply unit of the inkjet recording apparatus shown in FIG. 1.

FIG. 5 is a schematic drawing showing the configuration of the ink supply system in the inkjet recording apparatus 10. In FIG. 5, the direction from right to left is the breadthwise direction of the head 50, and the direction perpendicular to the recording paper is the lengthwise direction thereof.

The ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink supply tank 60 and the head 50 as shown in FIG. 5. The filter mesh size in the filter 62 is preferably equivalent to or less than the diameter of the nozzle and commonly about 20 μm.

It is preferable to provide a sub-tank (not shown in FIG. 5 but shown as a sub-tank 122 in FIG. 8) integrally to the print head 50 or nearby the head 50. The sub-tank has a damper function for preventing variation in the internal pressure of the head and a function for improving refilling of the print head.

Possible modes for controlling the internal pressure by means of the sub-tank are: a mode where the internal pressure of the pressure chamber 52 is controlled by the differential in the ink level between a sub tank which is open to the external air and the pressure chambers 52 inside the head 51; and a mode where the internal pressure of the sub tank and the pressure chambers is controlled by a pump connected to a sealed sub tank; and the like. Either of these modes may be adopted.

Description of Head Maintenance (First Embodiment)

A cap 64 forming a device for preventing the drying of the nozzles 51 or increase in the viscosity of the ink in the vicinity of the nozzles, is provided in the inkjet recording apparatus 10, and a wiping processing unit 13 is provided as a device for cleaning the nozzle forming surface 51A.

The maintenance unit including the cap 64 can be moved relatively with respect to the head 50 by a movement mechanism (not shown), and is moved from a predetermined holding position to a position below the head 50, as and when required.

The cap 64 is displaced up and down relatively with respect to the head 50 by an elevator mechanism (not shown). When the power is turned OFF or when the inkjet recording apparatus 10 is in a print standby state, the cap 64 is raised to a predetermined elevated position so as to come into close contact with the head 50, and the nozzle forming surface 51A is thereby covered with the cap 64.

During printing or standby, if the use frequency of a particular nozzle 51 is low, and if a state of not ejecting ink from the particular nozzle 51 continues for a prescribed time period or more, then the solvent of the ink in the vicinity of the particular nozzle 51 evaporates and the viscosity of the ink increases. In a situation of this kind, it will become difficult to eject ink from the particular nozzle 51, even if the piezoelectric actuator 58 is operated.

Therefore, before the inkjet recording apparatus 10 reaches a situation of this kind (while the ink is within a range of viscosity which allows it to be ejected by operation of the piezoelectric actuator 58), the piezoelectric actuator 58 is operated, and a preliminary ejection ("purge", "blank ejection" or "liquid ejection") is carried out toward the cap 64 (ink receptacle), in order to expel the degraded ink (namely, the ink in the vicinity of the nozzle which has increased viscosity).

Furthermore, if air bubbles enter into the ink inside the head 50 (inside the pressure chamber 52), then even if the piezoelectric actuator 58 is operated, it will not be possible to eject ink from the nozzle. In a case of this kind, the cap 64 is placed on the head 50, the ink (ink containing air bubbles) inside the pressure chamber 52 is removed by suction, by means of a suction pump 67, and the ink removed by suction is then supplied to a recovery tank 68. This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, desirably, preliminary ejection is carried out when the increase in the viscosity of the ink is still minor.

The wiping processing unit 13 includes: a blade 66 (wiping member) which moves in one direction in the breadthwise direction of the head 50 (the direction from right to left in FIG. 5 as indicated by the arrow) while abutting against the nozzle forming surface 51A so that foreign substances are removed from the nozzle forming surface (ink ejection surface) 51A of the head 50; a blade elevator mechanism (not illustrated) which moves the blade 66 in the upward and downward directions, thereby switching the blade 66 between states of contact and non-contact with the nozzle forming surface 51A; and a deaerated liquid supply nozzle 100 (see FIG. 6) which supplies a deaerated liquid (second liquid) to the portion of the blade 66 which makes contact with the nozzle forming surface 51A, and the vicinity of this portion.

Desirably, a hard rubber, or the like, is used for the blade 66. In other words, the blade 66 has a prescribed strength (rigidity) and a prescribed elasticity, and the surface thereof has prescribed hydrophobic properties which repulse the liquid ink droplets and deaerated liquid from its surface. The blade 66 is constituted by a member which is capable of wiping and removing ink (including ink that has solidified on the nozzle forming surface), paper dust, and other foreign matter, which have adhered to the nozzle forming surface 51A.

The deaerated liquid supply nozzle 100 is disposed in the vicinity of the blade 66 (on the side of forward travel in the movement direction of the blade 66 when wiping is performed), in such a manner that it can be moved relatively with respect to the head 50, together with the blade 66. Furthermore, the deaerated liquid supply nozzle 100 is connected to a deaerated liquid supply tank 106, via a deaerated liquid flow channel 102 and a pump 104. By operating the pump 104, the deaerated liquid accommodated in the deaerated liquid supply tank 106 is sent to the deaerated liquid supply nozzle 100. Accordingly, the device which supplies deaerated liquid includes the deaerated liquid supply nozzle 100, the deaerated liquid flow channel 102, the pump 104 and the deaerated liquid supply tank 106.

FIG. 5 shows just one deaerated liquid supply nozzle 100, but it is also possible to provide a plurality of deaerated liquid supply nozzles 100. In a mode where a plurality of deaerated liquid supply nozzles 100 are provided, it is desirable to arrange the deaerated liquid supply nozzles 100 in the breadthwise direction of the blade 66 (a direction substantially perpendicular to the movement direction of the blade 66). In a mode where a plurality of deaerated liquid supply nozzles 100 are provided in the breadthwise direction of the blade 66, it is possible to supply deaerated liquid substantially uniformly over the whole width of the blade 66, even if the blade 66 has a large width.

The wiping processing unit 13 is composed so as to be movable over the whole surface of the nozzle forming surface 51A of the head 50 by means of a wiping processing unit movement mechanism 110. In other words, the wiping processing unit 13 is composed so as to be movable in the breadthwise direction and the lengthwise direction of the head 50 independently and respectively, in the plane of the nozzle forming surface 51A (see FIGS. 17A and 17B).

The present embodiment relates to a mode where a full line head is used as the head 50, but it is also possible to use a serial system in which printing is performed in the breadthwise direction of the recording paper 16 by moving a short head of a shorter length than the width of the recording paper 16, in the breadthwise direction of the recording paper 16 (main scanning direction), and repeats printing in the breadthwise direction by relatively moving the recording paper 16 in the paper conveyance direction (the sub-scanning direction, which is substantially perpendicular to the main scanning direction). In the serial system described above, it is possible to omit the mechanism which moves the wiping processing unit 13 in the lengthwise direction of the head 50 (the breadthwise direction of the recording paper 16).

When a wiping process is performed, the blade 66 is abutted against the nozzle forming surface 51A and the wiping processing unit 13 is moved in one direction of the breadthways dimension of the head 50 (the right to left direction in FIG. 5 indicated by the arrow in FIG. 5), while deaerated liquid is supplied to the forward travel side of the blade 66 (the left-hand side of the blade 66 in FIG. 5), from the deaerated liquid supply nozzle 100. When one wiping action has been completed, the contact between the blade 66 and the nozzle forming surface 51A is terminated to be detached from each other, and the wiping processing unit 13 is moved in the opposite direction (the left to right direction in FIG. 5) from that during the implementation of the wiping process.

In a mode in which a blade 66 having a length substantially equal to or greater than the length of the head 50 in terms of the lengthwise direction (the length of blade 66≧the length of head 50 in lengthwise direction) is used, it is possible to carry out a wiping process over the whole area of the nozzle forming surface 51A of the head 50 by moving the blade 66 and the head 50 relatively to each other, once. Moreover, in a mode in which a short blade 66 having a length less than the length of the head 50 in the lengthwise direction (the length of blade 66<the length of head 50 in lengthwise direction) is used, then it is possible to carry out a wiping process over the whole area of the nozzle forming surface of the head 50, by performing a wiping action of moving the blade 66 in the breadthwise direction of the head 50, a plurality of times, while the blade is moved in the lengthwise direction of the head 50.

When one wiping process has been completed by moving the blade 66 from the end portion on the side of the wiping start position (the right-hand side of the head 50 in FIG. 5) to the end portion on the side of the wiping end position (the left-hand side of the head 50 in FIG. 5), then the pump 104 is reversely driven in such a manner that the deaerated liquid is sent in the inverse direction to that in the case where the deaerated liquid is supplied from the deaerated liquid supply tank 106 to the deaerated liquid supply nozzle 100. More specifically, the pump 104 is driven in such a manner that the deaerated liquid remaining on the nozzle forming surface 51A of the head 50 is recovered into the deaerated liquid supply tank 106, via the deaerated liquid supply nozzle 100.

A blade positional determination unit (reference numeral 130 in FIG. 7) including a detector (in the form of a positional sensor, encoder, or the like, for example) which determines the position of the wiping processing unit 13 (the blade 66) in the plane of the nozzle forming surface 51A of the head 50 is provided. The supply of the deaerated liquid, the upward and downward movement of the blade 66, and the driving of the pump 104 are controlled appropriately in accordance with the position of the wiping processing unit 13.

Furthermore, it is also possible to carry out a wiping process selectively with respect to one portion of the nozzle forming surface 51A of the head 50. For example, the contamination level of the nozzle forming surface 51A of the head 50 is judged by means of a soiling determination sensor (not illustrated), such as an optical reflection sensor, and if only a portion of the nozzle forming surface 51A is soiled, then the wiping processing unit is moved to the corresponding region, and a wiping process is carried out with respect to the corresponding region (and the vicinity of this corresponding region).

Figure 6:
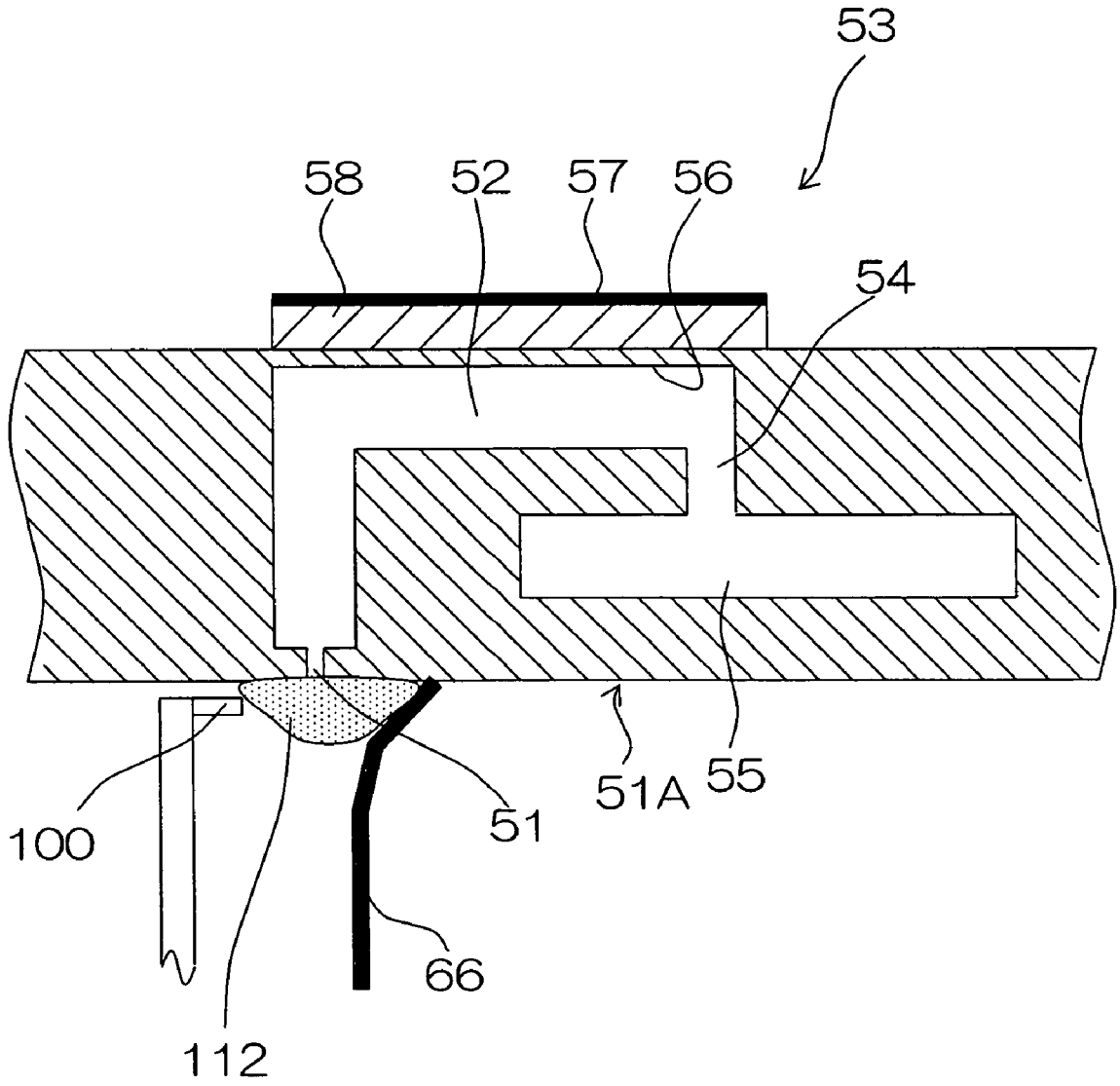
FIG. 6 is a conceptual diagram describing a wiping process according to an embodiment of the present invention.

FIG. 6 shows a state during the execution of the wiping process using the blade 66. As shown in FIG. 6, by carrying out a wiping process while the deaerated liquid 112 is supplied from the deaerated liquid supply nozzle 100 (while the deaerated liquid 112 is applied), the incorporation of air bubbles into the nozzles 51 is suppressed. Furthermore, even if air bubbles are incorporated into the nozzles 51, these air bubbles can be dissolved in the deaerated liquid so that the air bubbles can be eliminated. Moreover, by establishing the contact between the deaerated liquid 112 and the meniscus, it is also possible that the dissolved gas in the vicinity of the meniscus becomes dissolved into the deaerated liquid 112 so as to raise the level of deaeration in the vicinity of the meniscus (namely, to reduce the amount of dissolved gas in the vicinity of the meniscus).

The deaerated liquid is a liquid having a dissolved gas volume of 0 to 2 (mg/l), and contains a component of the ink used for image formation, for example. Concrete embodiments of the deaerated liquid include ink, purified water, and a transparent ink which is obtained by removing coloring material from the ink. Desirably, the deaerated liquid has a composition similar to the ink used for image formation, and hence it is suitable to use the ink or transparent ink described above.

Description of Control System

Figure 7:
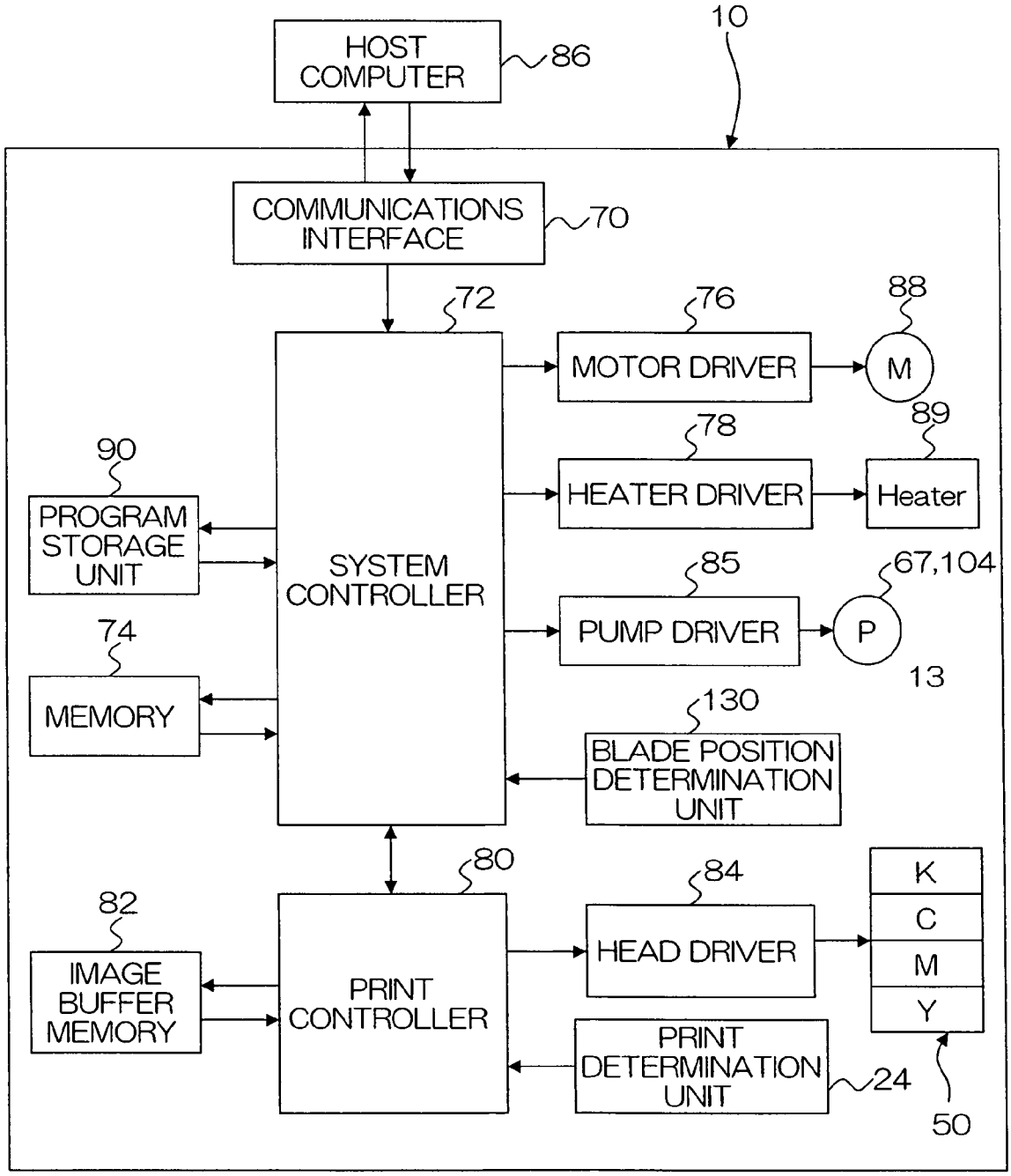
FIG. 7 is a principal block diagram showing a system composition of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, a pump driver 85 and the like.

The communication interface 70 is an interface unit for receiving image data sent from a host computer 86. A serial interface such as USB (Universal Serial Bus), IEEE1394, Ethernet®, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver 76 is a driver (drive circuit) which drives the motor 88 in accordance with instructions from the system controller 72. The motor driver 76 and the motor 88 in FIG. 7 respectively include a plurality of motor drivers and motors. In other words, the system controller 72 controls the plurality of motors by means of the plurality of motor drivers.

Embodiments of the plurality of motors include: a motor which causes the rollers 31 and 32 in FIG. 1 to rotate; a motor of the movement mechanism of the wiping processing unit shown in FIG. 6; a motor of the blade elevator mechanism which moves the blade 66 in the upward and downward directions; and the like.

Moreover, the heater driver 78 drives the heater 89 of the post-drying unit 42, and the like, in accordance with commands from the system controller 72. The heater 89 shown in FIG. 7 includes heaters such as a heater used in a post-drying unit 42 shown in FIG. 1, a temperature adjustment heater for the head 50, and the like.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators of the heads of the respective colors 12K, 12C, 12M and 12Y on the basis of print data supplied by the print controller 80. The head driver 84 can be provided with a feedback control system for maintaining constant drive conditions for the print heads.

The pump driver 85 is a control block which controls the pump 104 and the suction pump 67 shown in FIG. 5, on the basis of control signals sent by the system controller 72. The pump driver 85 controls the on/off switching, the operational speed, the drive direction, and the like, of the suction pumps 67 and 104, and the like.

The program storage unit 90 stores control programs for the inkjet recording apparatus 10, and the system controller 72 reads out the various control programs stored in the program storage unit 90, as and when appropriate, and executes the control programs.

The blade position determination unit 130 determines the relative position of the wiping processing unit 13 with respect to the head 50, and sends the positional information of the wiping processing unit 13 to the system controller 72. The system controller 72 controls the motor of the wiping processing unit movement mechanism 110 and the motor of the elevator mechanism for the blade 66, via the motor driver 76, on the basis of the positional information relating to the wiping processing unit 13, and also controls the pump 104 via the pump driver 85.

For the method of determining the position of the wiping processing unit 13, the following methods may be used: the position of the wiping processing unit 13 may be determined directly, by means of a positional determination sensor (for example, a linear encoder or linear scale); or the position of the wiping processing unit 13 may be determined indirectly by determining the amount of rotation of the motor according to the output pulse signal of an encoder attached to the motor of the wiping processing unit movement mechanism 110, and then converting this amount of rotation of the motor into an amount of movement of the wiping processing unit 13.

To describe the wiping control described above in this embodiment, during the implementation of the wiping process, the head 50 (print unit 12) is moved to the withdrawal position and the wiping processing unit 13 and the wiping processing unit movement mechanism 110 are moved to the prescribed default position. In this state, the relative positions of the head 50 and the wiping processing unit 13 (blade 66) are adjusted. When the relative positions of the head 50 and the wiping processing unit 13 have been adjusted, then the blade 66 is abutted against the nozzle forming surface 51A of the head 50, and the wiping processing unit 13 is moved in one direction in the breadthwise direction of the head 50 while deaerated liquid is supplied from the deaerated liquid supply nozzle 100 to the vicinity of the abutment position of the blade 66 against the nozzle forming surface 51A.

When the wiping processing unit 13 (blade 66) has moved from the end portion of the head 50 on the wiping start side of the head in the breadthwise direction to the end portion of the head 50 on the wiping end side, then the drive direction of the pump 104 is switched so as to reverse the direction of liquid sending, so that the deaerated liquid collected on the nozzle forming surface 51A of the head 50 is recovered via the deaerated liquid supply nozzle 100. When the recovery of the deaerated liquid has been completed, then the blade 66 is moved downwards so that the blade 66 is separated from the nozzle forming surface 51A, the wiping processing unit 13 is then moved in the opposite direction to that during the wiping operation (namely, the direction from the end portion on the wiping end side toward the end portion on the wiping start side), and the wiping processing unit 13 is moved to the default position.

Figure 8:
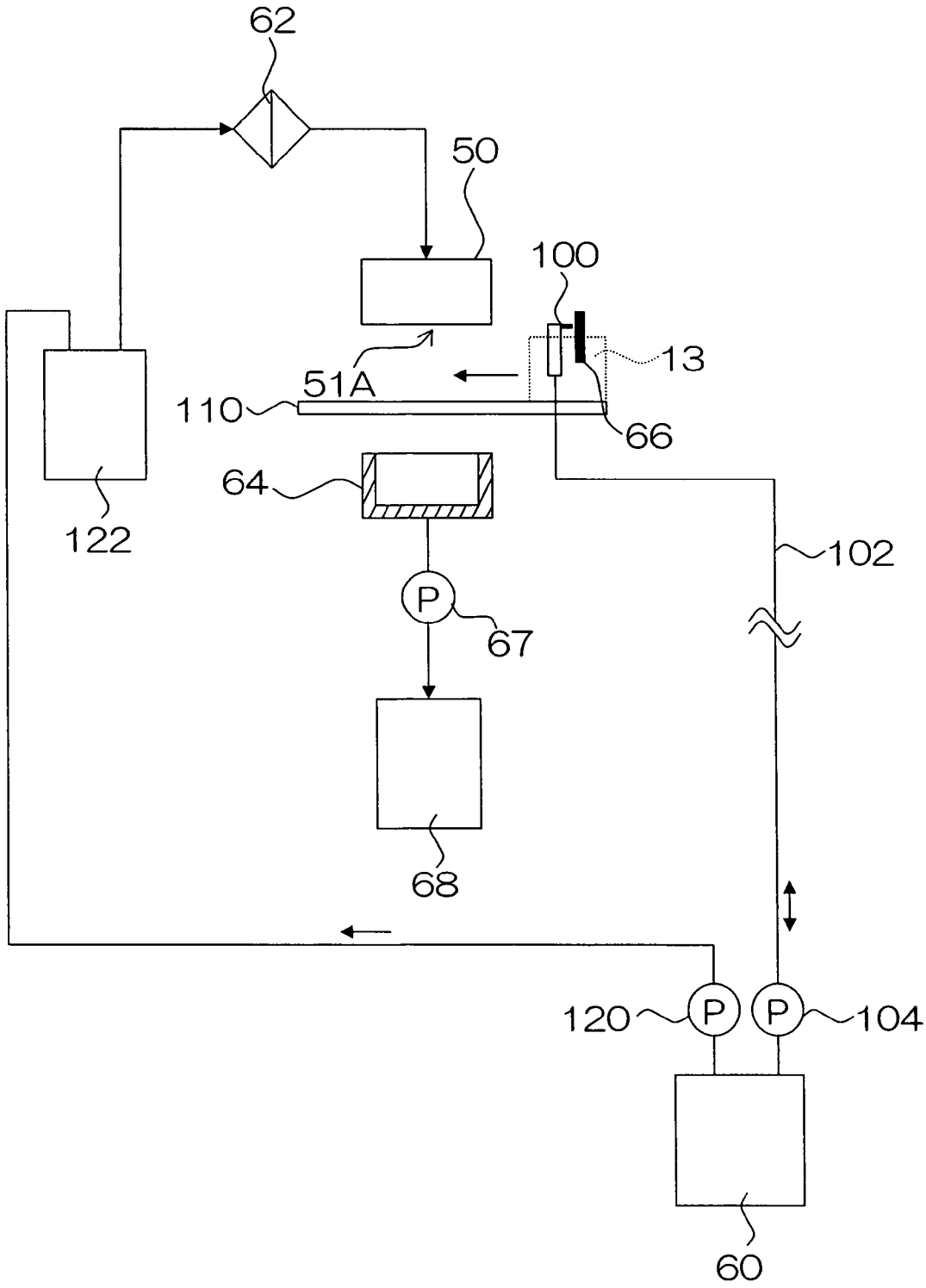
FIG. 8 is a schematic drawing showing a modification of the deaerated liquid supply unit shown in FIG. 7.

FIG. 8 shows another mode of the ink and deaerated liquid supply system shown in FIG. 5. In FIG. 8, items which are the same as or similar to those in FIG. 5 are labeled with the same reference numerals and description thereof is omitted here.

In the mode shown in FIG. 8, ink for image formation is used as the deaerated liquid, and the ink supply tank 60 and the deaerated liquid supply tank 106 shown in FIG. 5 are combined. Furthermore, a pump 120 and a sub-tank 122 are provided between the ink supply tank 60 and the head 50. In a mode in which ink is used as the deaerated liquid, it is possible to omit the deaerated liquid supply tank 106, as shown in FIG. 8.

In the inkjet recording apparatus 10 having the above-mentioned structure, when a wiping process for the nozzle forming surface 51A of the head 50 is carried out by using the wiping processing unit 13, a deaerated liquid is supplied from the deaerated liquid supply nozzle 100 to the portion where the blade 66 makes contact with the nozzle forming surface 51A, and the vicinity of this portion. Therefore, the incorporation of air bubbles into the nozzles 51 during implementation of the wiping process is suppressed, and even if air bubbles are incorporated into the nozzles 51, then these air bubbles can be eliminated by becoming dissolved into the deaerated liquid.

Figure 9:
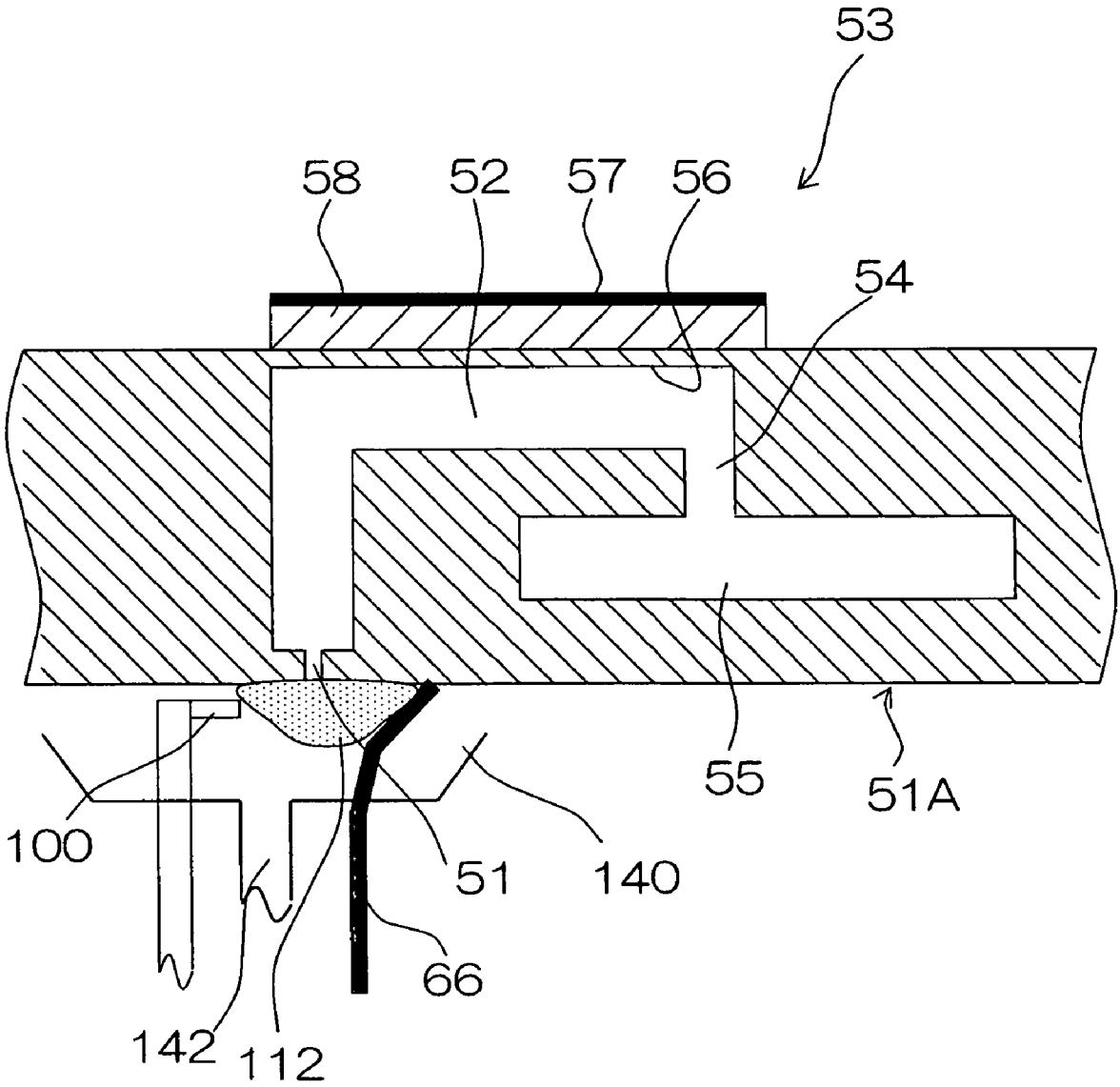
FIG. 9 is a conceptual diagram describing a wiping process according to a second embodiment of the present invention.
Figure 10:
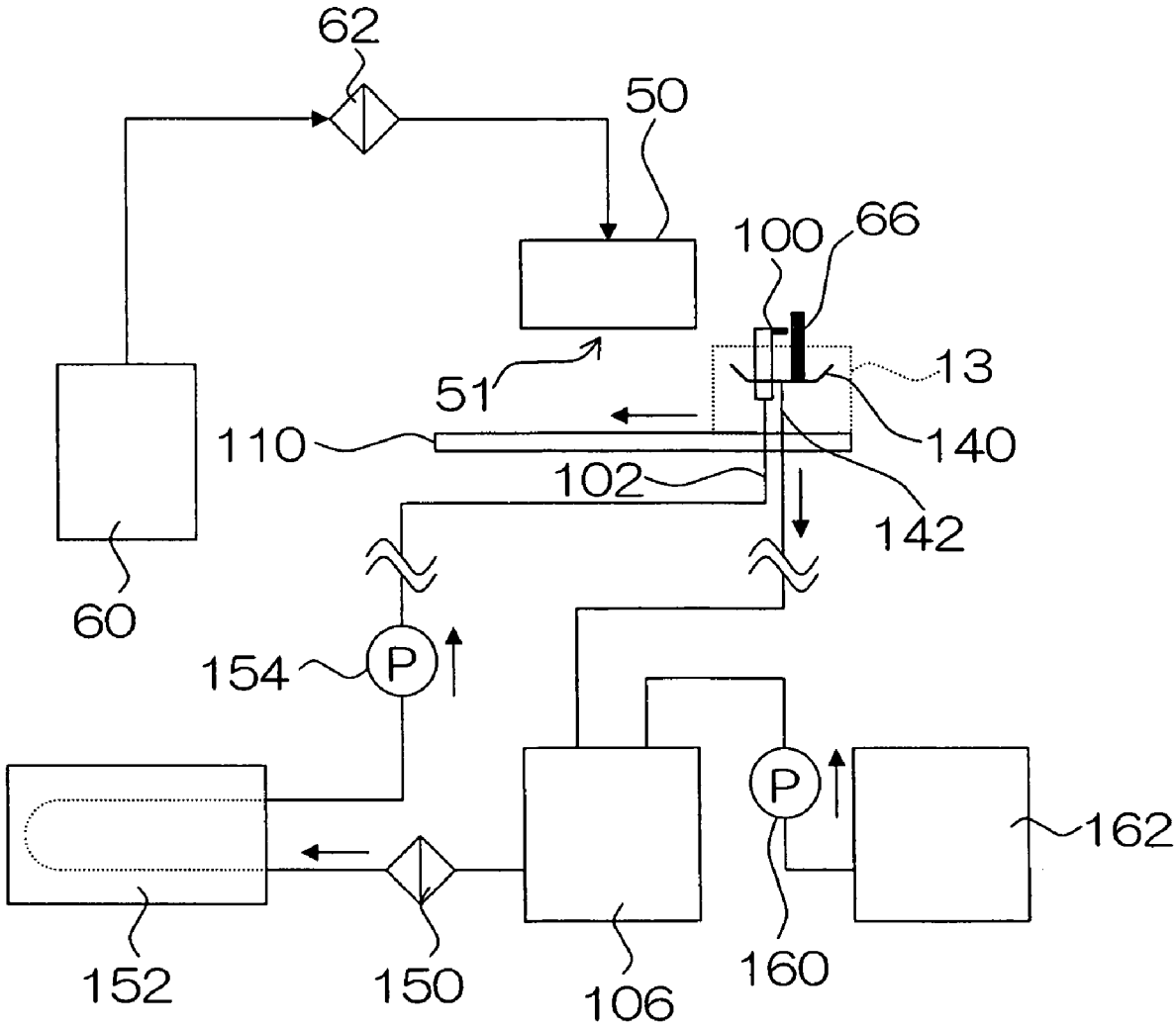
FIG. 10 is a schematic drawing showing the composition of a deaerated liquid supply unit according to the second embodiment.

It is possible to provide one wiping processing unit 13 for each head 50, or to share a wiping processing unit 13 between a plurality of heads. It is also possible to provide one wiping processing unit 13 or a smaller number of wiping processing units 13 than the number of heads, for a plurality of heads. In the inkjet recording apparatus 10 shown in the present embodiment, it is possible to adopt a mode in which one to four wiping processing units 13 are provided with respect to the four heads 12K, 12C, 12M and 12Y Second Embodiment Next, a second embodiment of the present invention is described below. FIG. 9 is a diagram which shows a wiping process according to the second embodiment; and FIG. 10 is a schematic diagram showing the composition of a supply system according to the second embodiment. In the inkjet recording apparatus 10 according to the second embodiment, the deaerated liquid that has been supplied during the wiping process (the deaerated liquid that has been used) is recovered, and the used deaerated liquid thus recovered is subjected to a deaeration process by means of a deaeration apparatus, in such a manner that the used deaerated liquid can be reused.

As shown in FIG. 9, the inkjet recording apparatus 10 includes: a recovery member 140 which recovers the deaerated liquid supplied to the nozzle forming surface 51A; and a circulation channel 142 for returning the used deaerated liquid gathered in the recovering member 140 to the deaerated liquid supply tank 106 (not shown in FIG. 9). In this inkjet recording apparatus 10, the used deaerated liquid gathered in the recovery member 140 is returned to the deaerated liquid supply tank 106, via the circulation channel 142.

As shown in FIG. 10, the flow channel along which the deaerated liquid flows from the deaerated liquid supply tank 106 into the deaerated liquid supply nozzle 100 is provided with a filter 150 for removing foreign matter which has become mixed into the deaerated liquid, a deaeration apparatus 152 which carries out a deaeration process for the deaerated liquid that has passed through the filter 150, and a pump 154 for sending the deaerated liquid that has been subjected to the deaeration process by the deaeration apparatus 152, to the deaerated liquid supply nozzle 100.

A dissolved oxygen meter (not illustrated) is provided in the deaeration apparatus 152 (or on the input side of the deaeration apparatus 152). When an amount of dissolved oxygen in the deaerated liquid as measured by the amount of dissolved oxygen meter is equal to or greater than a prescribed value, then the deaeration apparatus 152 is operated and thereby a deaeration process of the deaerated liquid is carried out. If an amount of the dissolved oxygen is less than the prescribed value, then the deaeration apparatus 152 is controlled in such a manner that the deaerated liquid is not subjected to the deaeration process. A member having prescribed air-sealing properties is used for the flow channel from the deaeration apparatus 152 to the deaerated liquid supply nozzle 100.

Furthermore, a deaerated liquid volume determination unit (not illustrated) which determines the volume of deaerated liquid inside the deaerated liquid supply tank 106 is provided, and if the volume of deaerated liquid inside the deaerated liquid supply tank 106 becomes equal to or less than a prescribed amount, then the pump 160 is operated and deaerated liquid accommodated in a replenishment tank 162 is replenished into the deaerated liquid supply tank 106.

Desirably, the volume of deaerated liquid inside the deaerated liquid supply tank 106 is determined by using a level sensor which determines the liquid level inside the deaerated liquid supply tank 106, since this makes it possible to establish a fast determination speed and to achieve an inexpensive composition for the determination of the deaerated liquid volume inside the deaerated liquid supply tank 106. However, if it is difficult to install such a liquid level sensor, or if the variation in the liquid level in the deaerated liquid supply tank 106 is large because of a small volume of the deaerated liquid supply tank 106, for example, then it is also possible to measure the weight of the deaerated liquid supply tank 106 and convert the weight into a volume of the deaerated liquid.

A mode where the used deaerated liquid is recovered and reused after carrying out a deaeration process not only contributes to reducing the consumption of the deaerated liquid, but also makes it possible to keep the amount of dissolved gas in the deaerated liquid supplied from the deaerated liquid supply nozzle 100, at or below a prescribed value.

Figure 11:
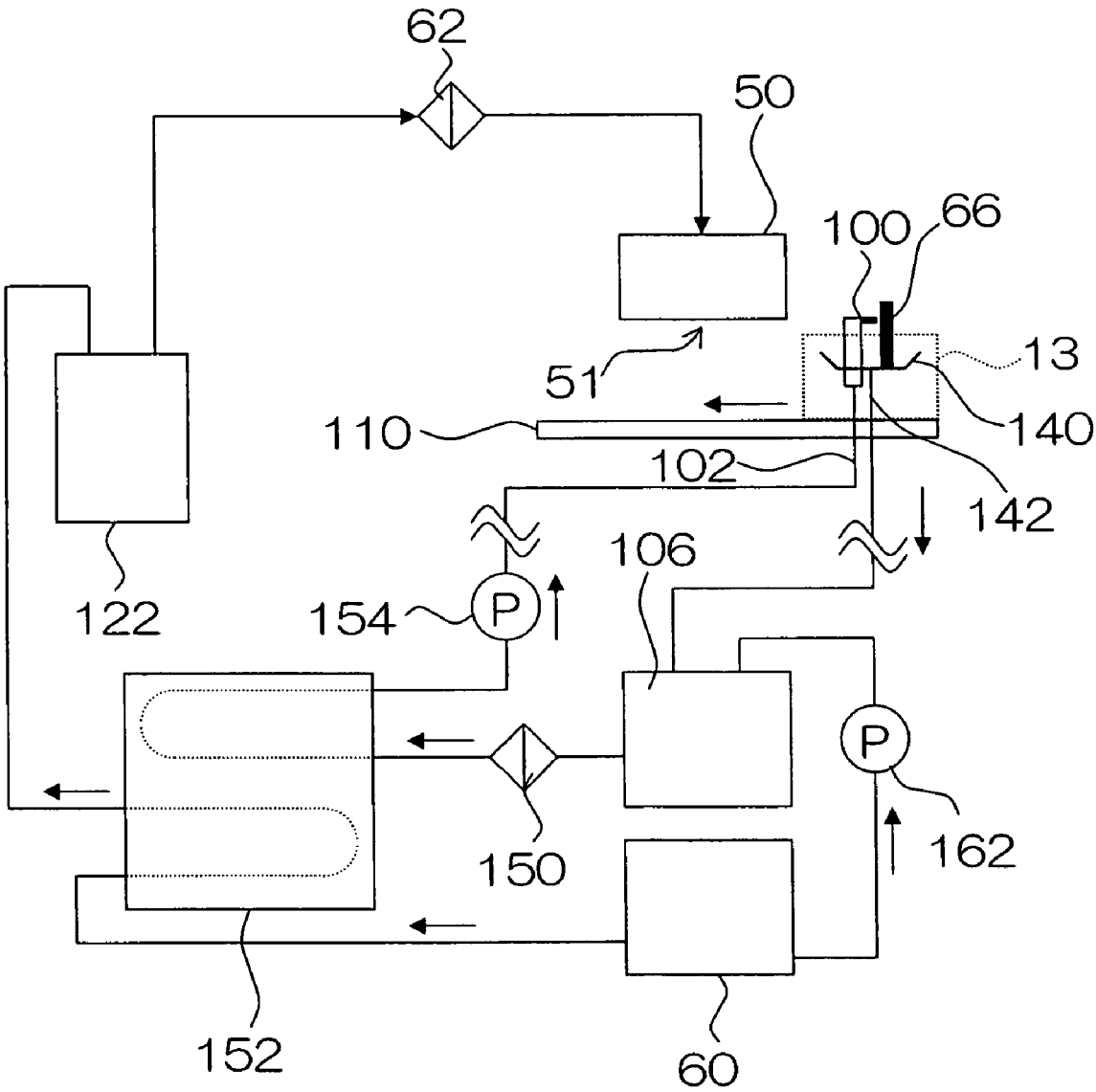
FIG. 11 is a schematic drawing showing a modification of the deaerated liquid supply unit shown in FIG. 10.

FIG. 11 shows a mode where the deaeration apparatus for the ink supplied to the head 50 and the deaeration apparatus for the deaerated liquid sent to the deaerated liquid supply nozzle 100 are combined into one apparatus. In other words, the deaeration apparatus 152 carries out a deaeration process of the ink supplied to the head 50 from the ink supply tank 60, via the sub tank 122, and also carries out a deaeration process of the deaerated liquid supplied to the deaerated liquid supply nozzle 100 from the deaerated liquid supply tank 106. The sub tank 122 shown in FIG. 11 uses a sealed type of sub-tank.

According to the mode shown in FIG. 11, space saving in the apparatus (compactification of the apparatus) is achieved by combining the deaeration apparatus for the ink supplied to the head 50 and the deaeration apparatus for the deaerated liquid supplied to the deaerated liquid supply nozzle 100, and this contributes to reducing the cost of the apparatus.

Third Embodiment

Figure 12:
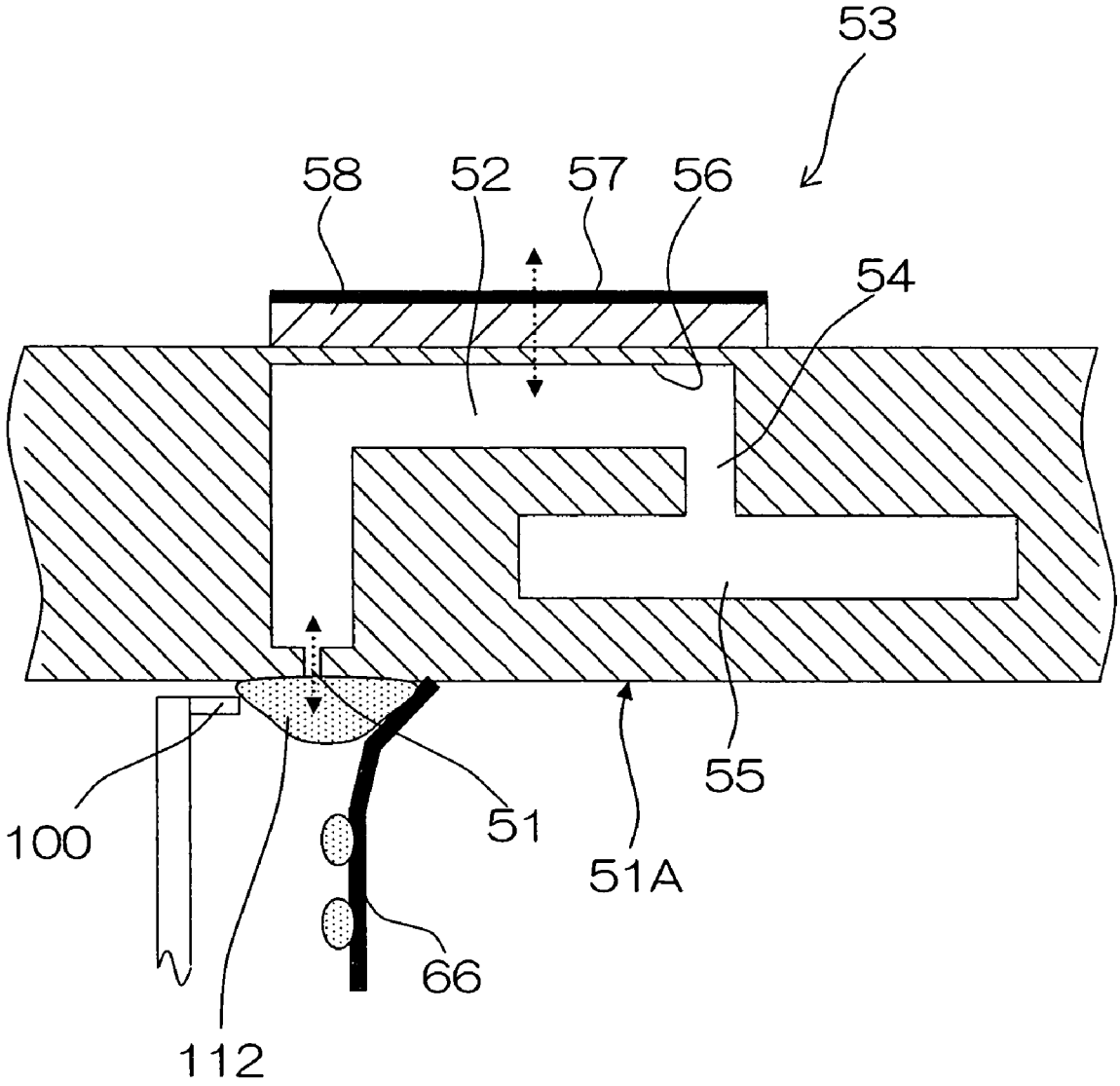
FIG. 12 is a conceptual diagram describing a wiping process according to a third embodiment of the present invention.

Next, a third embodiment of the present invention is described below. FIG. 12 is a diagram which describes a wiping process according to the third embodiment. In the present embodiment, a slight vibration (indicated by the arrow on either side of the dotted line in FIG. 12) is applied to the meniscus surface during implementation of a wiping process.

In other words, the position of the blade 66 (wiping processing unit 13) is determined, and when a nozzle is in a state where the deaerated liquid 112 is in contact with the meniscus of the nozzle (in other words, a nozzle is in the region where the deaerated liquid 112 is present), then the piezoelectric actuator 58 corresponding to that nozzle 51 is actuated, thereby imparting a slight vibration to the meniscus formed in the nozzle 51.

When a slight vibration is applied to the meniscus, if the piezoelectric actuator 58 is operated by using a drive signal (drive signal for slight vibration of meniscus) which has a lower voltage (amplitude) than the drive signal used for ejection, then the piezoelectric actuator 58 imparts a pressure of a level that does not cause ink to be ejected from the nozzle 51, to the ink inside the pressure chamber 52 (the direction of this pressure is indicated by the arrow on either side of the dotted line in FIG. 12). Furthermore, it is also possible to apply a drive signal which has a higher frequency (for example, in the order of several times to several tens of times) than the drive signal used for ejection.

In this way, according to a mode in which a slight vibration is applied to the meniscus during the wiping process, the deaerated liquid and the ink inside the nozzles 51 are agitated, and consequently the foreign matter and/or solidified ink in the vicinity of the nozzles can be removed. Moreover, the deaerated liquid is made to enter into the interior of the nozzles 51, and hence improved efficiency can be expected in causing the gas dissolved in the ink to become dissolved into the deaerated liquid.

If the amplitude of the slight vibration of the meniscus is increased, then the agitation efficiency of the ink and the deaerated liquid is also increased, and therefore it is desirable to set the amplitude of the slight vibration of the meniscus to the maximum possible amplitude at which ink is not ejected from the nozzles 51.

Furthermore, in a mode where a slight vibration is applied to the meniscus, the "pool amount" (supply volume) of the deaerated liquid is decided in such a manner that the ink does not burst through the deaerated liquid when the pressure for slight vibration of the ink inside the nozzles 51 is applied. Moreover, since there is a high probability that air bubbles may enter inside a nozzle 51 if a vibration is applied in a state where the meniscus is in contact with the air, then the volume of deaerated liquid to be supplied is decided in such a manner that the diameter of the pool of deaerated liquid is greater than the diameter of the nozzle 51 and hence the deaerated liquid covers the whole area of the nozzle 51 when a slight vibration is applied to the meniscus of that nozzle.

Fourth Embodiment

Next, a fourth embodiment of the present invention is described below. In the fourth embodiment, a device for determining a nozzle where an ejection abnormality is provided, and a wiping process is carried out selectively with respect to nozzles where ejection abnormalities occur. In the wiping process according to the present embodiment, suctioning is not necessary after carrying out the wiping process, and therefore it is possible to carry out a localized restoration process.

For the method of determining nozzles that have ejection abnormalities, a method where a test image is printed, the test image is then read in by using the print determination unit 24 shown in FIG. 1, and the ejection abnormality nozzles are identified on the basis of the results thus read in, may be used. Moreover, the ejection abnormality nozzles may be identified on the basis of pressure abnormalities of the piezoelectric actuators 58.

Figure 13:
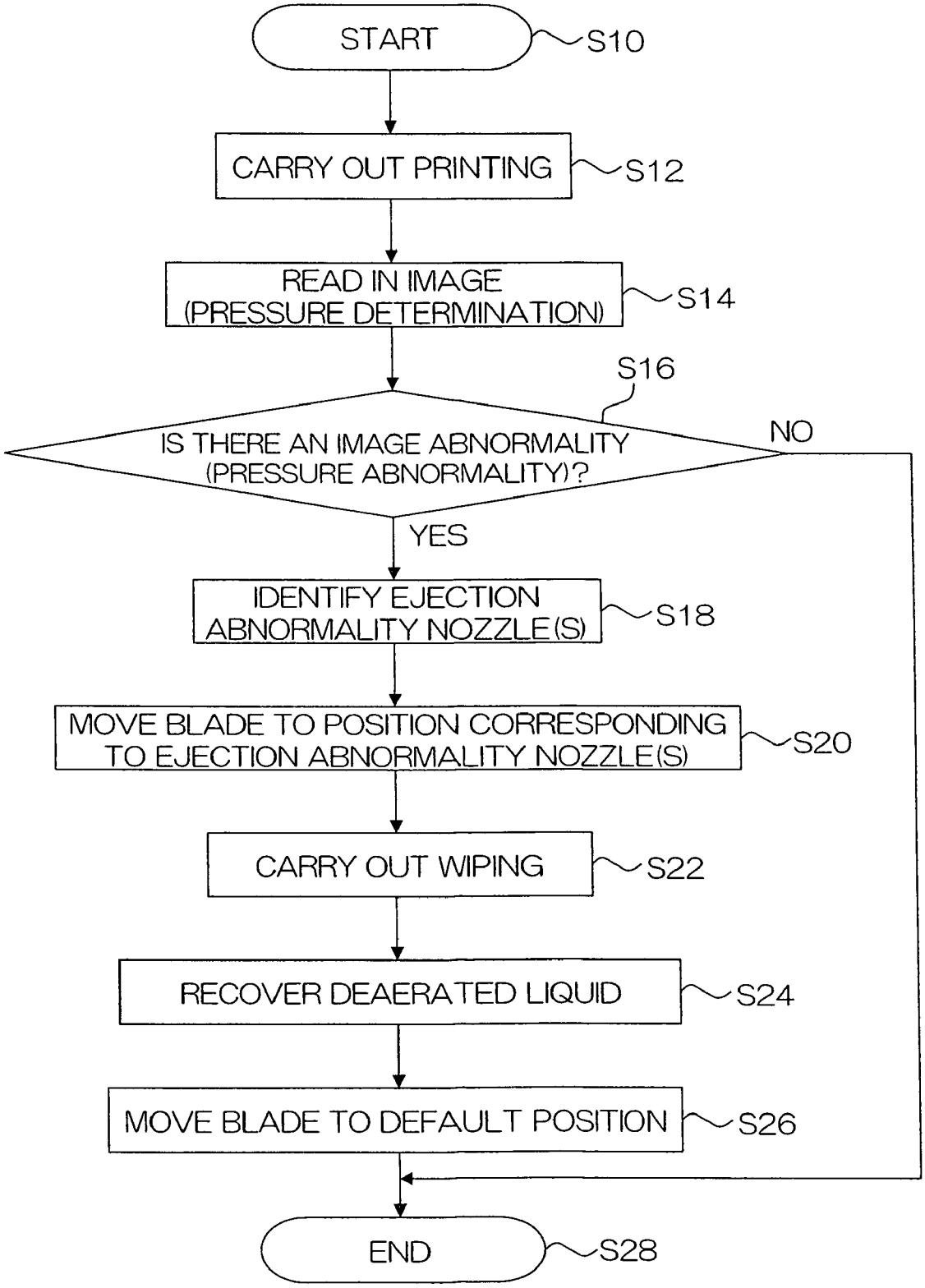
FIG. 13 is a flowchart showing a sequence of wiping control according to a fourth embodiment of the present invention.

FIG. 13 is a flowchart showing the sequence of control of a wiping process according to the fourth embodiment. When the wiping process is started (step S10), a test print is carried out (step S12) and the test image is read in by the print determination unit 24 shown in FIG. 1 (step S14).

The presence or absence of an image abnormality is judged from the results read in by the print determination unit 24 (step S16). If it is judged that there is an image abnormality (YES verdict), then an ejection abnormality nozzle is identified on the basis of the position at which the abnormality occurs on the test image (step S18). The judgment of the image abnormality in step S16 is based on the presence or absence of dot formations, the positions of the dots, and the size of the dots.

When an ejection abnormality nozzle has been identified at step S118, the blade 66 (wiping processing unit 13) is moved to the position corresponding to the ejection abnormality nozzle (step S20), and a wiping process is carried out with respect to that ejection abnormality nozzle (step S22).

When the wiping process in step S22 has been completed, the deaerated liquid is recovered (step S24), the blade 66 is moved to the default position (step S26), and the wiping process then terminates (step S28). If no image abnormality (ejection abnormality nozzle) is discovered at step S16 (NO verdict), then the procedure advances to step S28 and the wiping process terminates.

If a plurality of ejection abnormality nozzles are discovered, then the wiping processing unit 13 is controlled in such a manner that the wiping process described above is carried out for each of the ejection abnormality nozzles, and hence all of the ejection abnormality nozzles are subjected to the wiping process. It is possible for the wiping processing unit 13 to perform a wiping process with respect to a region corresponding to a plurality of nozzles, in one wiping operation. If a plurality of ejection abnormality nozzles are located within a region that can be handled in a single wiping operation, then one wiping operation is carried out for that plurality of ejection abnormality nozzles.

A mode where the ejection abnormality nozzles are identified and a wiping process is carried out with respect to the ejection abnormality nozzles in this way contributes to shortening the time period required for the recovery operation, and helps to reduce the consumption of the deaerated liquid. Furthermore, increased viscosity of the ink inside the nozzles which have not been wiped is suppressed by the shortening of the restoration operation time.

In step S14 in FIG. 13, instead of reading in a test image, it is also possible to determine the pressure in the pressure chambers 52, and then judge the presence or absence of pressure abnormalities of the pressure chambers 52 according to the determined results in step S16, and identify ejection abnormality nozzles at step S18. If ejection abnormality nozzles are identified on the basis of pressure abnormalities in pressure chambers 52, then it is not necessary to print a test image at step S12, and pressure abnormalities of the pressure chambers 52 can be determined while an actual image is formed.

First Modification Embodiment Of Blade

Figure 14A:
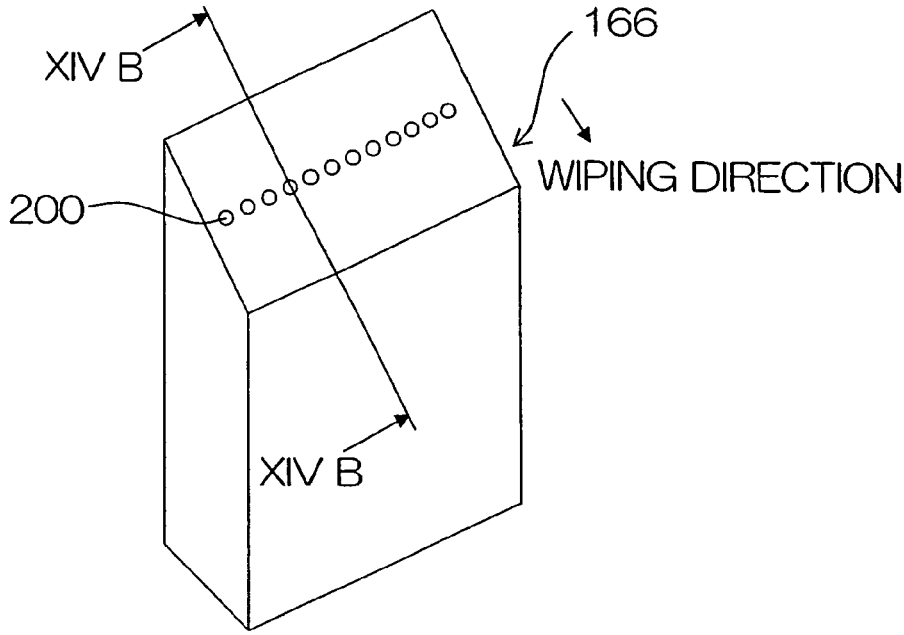
FIGS. 14A to 14C are diagrams showing modifications of the blade shown in FIG. 5.

Next, a modification embodiment of the blade provided in the wiping processing unit 13 is described below. The blade 166 shown in FIG. 14A is formed with deaerated liquid supply nozzles 200 on the surface 166A (called the "contact surface" below) which makes contact with the nozzle forming surface 51A (not shown in FIG. 14A). Furthermore, the blade 166 shown in FIG. 14A has a shape which is cut obliquely in such a manner that the contact surface area between the contact surface 166A and the nozzle forming surface 51A is increased.

According to a mode in which deaerated liquid supply nozzles 200 are provided on the contact surface 166A of the blade 166, as shown in FIG. 14A, a deaerated state can be maintained in the vicinity of the meniscus by forming a pool of deaerated liquid (reference numeral 112 in FIG. 6) in the vicinity of the contact region between the contact surface 166A and the nozzle forming surface 51A, rather than deaerated liquid being sprayed from the deaerated liquid supply nozzles 200.

Furthermore, by composing the blade 166 and the deaerated liquid supply nozzles 200 in an integrated fashion, it becomes possible to provide the blade 166 and the deaerated liquid supply nozzles 200 within a narrow region and hence a plurality of blades 166 can be provided in the wiping direction.

FIG. 14A shows a mode in which a plurality of deaerated liquid supply nozzles 200 are arranged in one row following a direction substantially perpendicular to the wiping direction (indicated by the arrow in FIG. 14A). It is also possible to arrange the deaerated liquid supply nozzles 200 in a two-dimensional configuration, or to arrange a plurality of deaerated liquid supply nozzles 200 in an irregular fashion. In the structure in which the plurality of deaerated liquid supply nozzles 200 are arranged in a two-dimensional configuration or an irregular configuration, even if the nozzle forming surface 51A has an undulating shape, it is possible to supply the deaerated liquid uniformly in the breadthwise direction of the blade 166 by arranging the deaerated liquid supply nozzles 200 so as to avoid the projecting sections.

Moreover, even if the nozzles 51 for ejecting ink which are formed on the nozzle forming surface 51A are arranged in a non-uniform fashion, it is still possible to carry out an appropriate wiping process by providing deaerated liquid supply nozzles 200 in greater number in the regions where the nozzles 51 are disposed more densely.

Figure 14B:
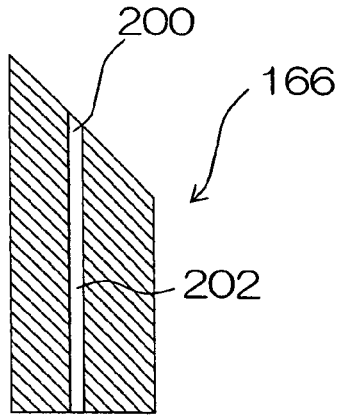
Figure 14C:
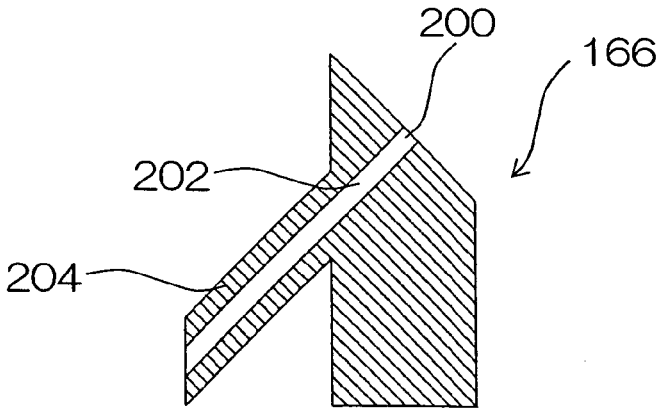

FIG. 14B is a diagram (a cross-sectional view along line XIV B-XIV B in FIG. 14A) which shows an embodiment of the composition of a deaerated liquid flow channel 202 that connects to a deaerated liquid supply nozzle 200. If deaerated liquid flow channels 202 are formed inside the blade 166 as shown in FIG. 14B, then even if the blade 166 is made of a readily deformable material, such as an elastic body, which causes the deaerated liquid flow channels 202 to be squashed during the wiping action, it is still possible to supply deaerated liquid in a stable fashion. This is because the deaerated liquid flow channels 202 inside the blade 166 are small. Moreover, as shown in FIG. 14C, it is also possible to join a flow channel member 204 formed with deaerated liquid flow channels 202, to the blade 166, and to connect the deaerated liquid supply nozzles 200 to the deaerated liquid flow channels 202. A member having prescribed air-sealing characteristics (for example, a metal member) is used for the deaerated liquid flow channels 202.

Second Modification Embodiment of Blade

Next, a further modification embodiment of the blade included in the wiping processing unit 13 is described below. In a blade 166' shown in FIG. 15, the end portions in terms of the direction substantially perpendicular to the wiping direction (as indicated by the arrow in FIG. 15) are formed of porous members 208 having liquid absorbing properties.

Figure 15:
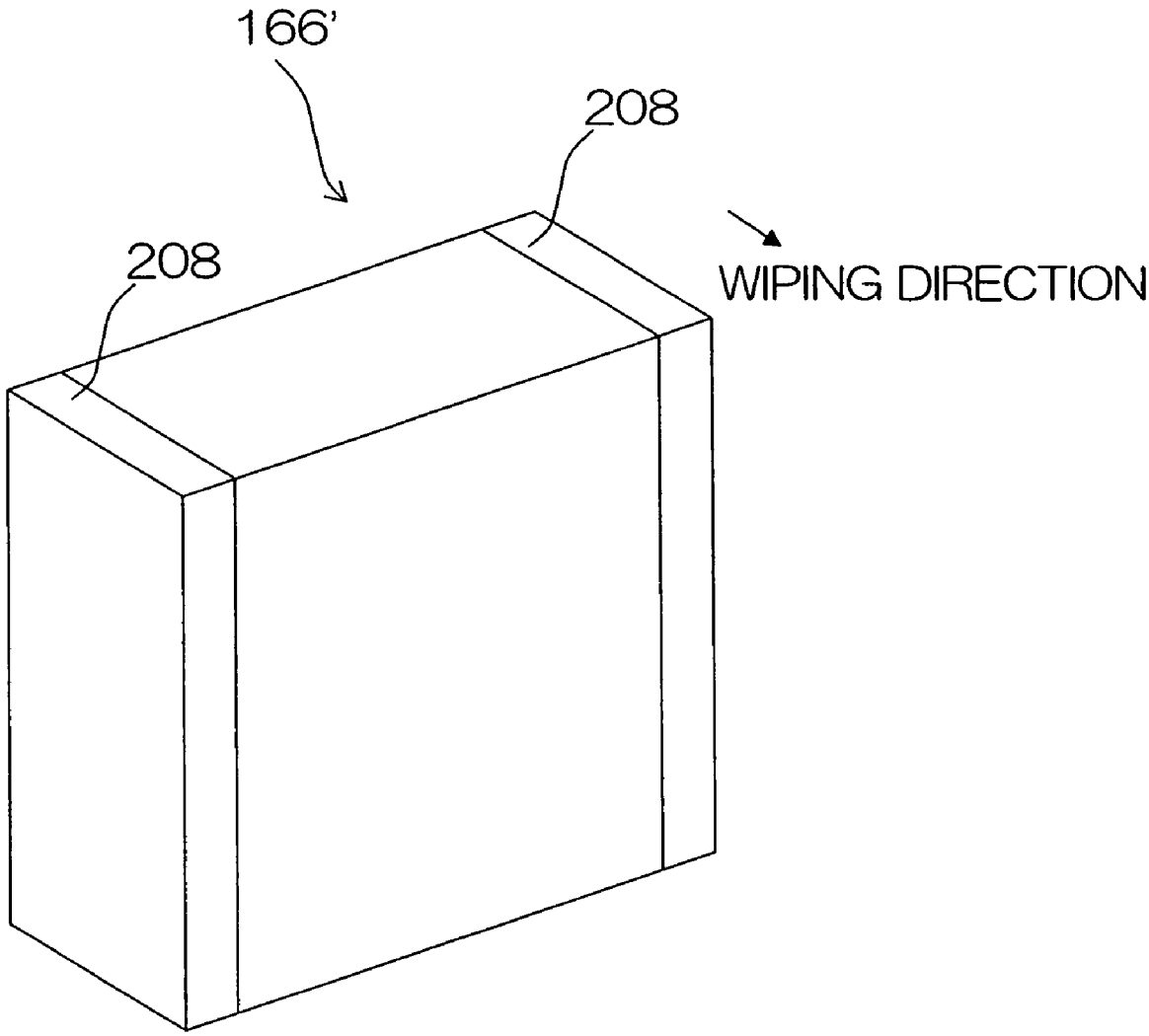
FIG. 15 is a diagram showing a further modification of the blade shown in FIG. 5.

According to the blade 166' shown in FIG. 15, the porous members 208 absorbs the deaerated liquid so that the liquid volume of the liquid pool formed in the vicinity of the contact region between the blade 166' and the nozzle forming surface 51A (not shown in FIG. 15) is regulated, and therefore liquid residue after wiping, which may arise if the liquid pool has a large volume, is suppressed. Furthermore, since the volume of deaerated liquid recovered after completion of the wiping process is reduced, then it is possible to reduce the burden of recovery of deaerated liquid after use, and the burden of processing this deaerated liquid.

Third Modification Embodiment of Blade

Figure 16:
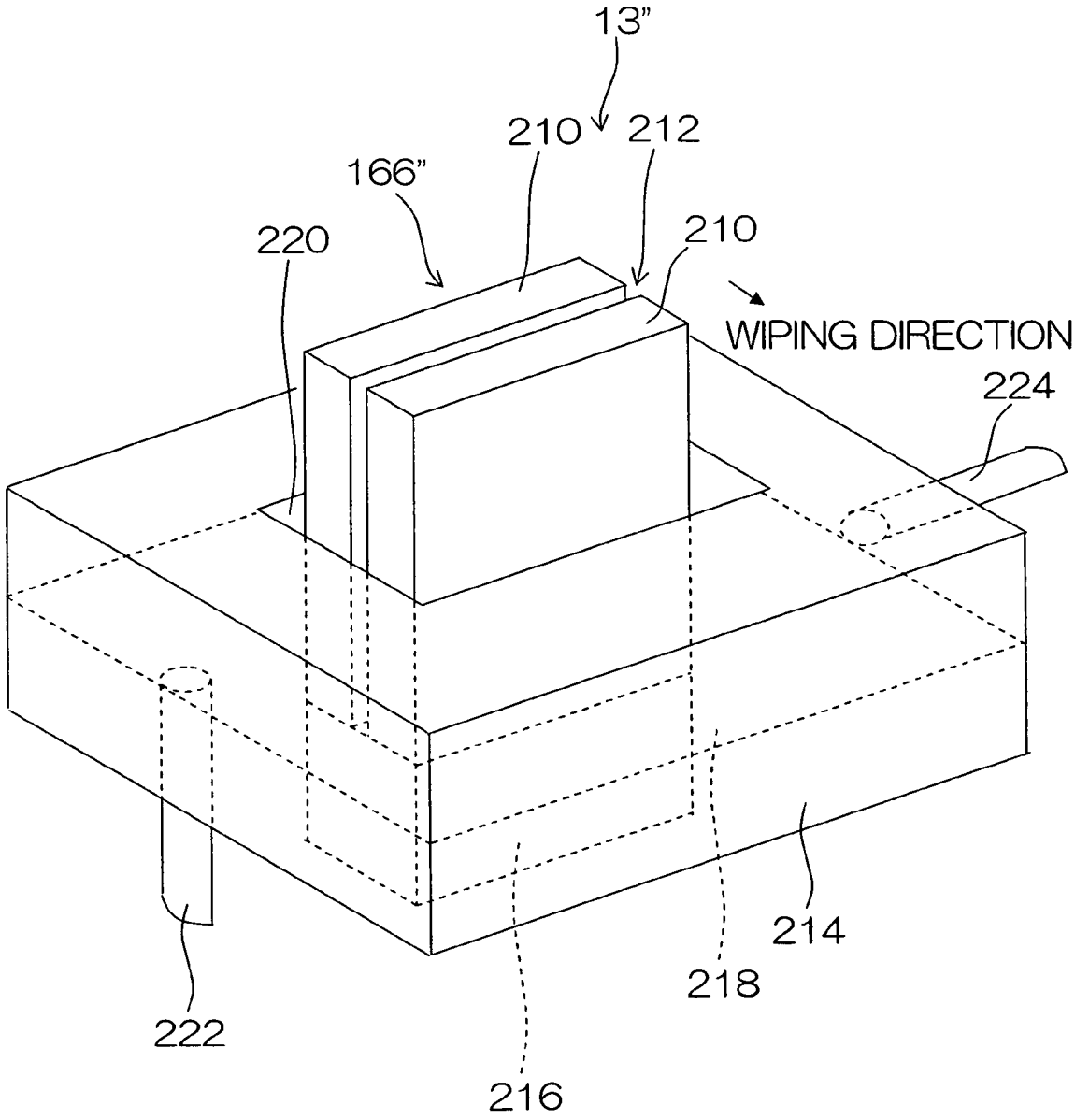
FIG. 16 is a diagram showing yet a further modification of the blade shown in FIG. 5.

FIG. 16 shows a further mode of the blade included in the wiping processing unit 13. The blade 166" shown in FIG. 16 includes two hard rubber members 210 (the same members as the blades 66, 166 or 166' described above), and a gap 212, which fills with deaerated liquid 212, is provided between the two hard rubber members 210. The wiping processing unit 13" shown in FIG. 16 includes a deaerated liquid accumulation container 214 which accumulates deaerated liquid to be filled into the gap 212 and holds the blade 166" in position.

More specifically, the deaerated liquid accumulation container 214 comprises: a blade holding member 216 which holds the blade 166"; a deaerated liquid pool 218 which accumulates deaerated liquid and in which approximately the lower half of each of the blade 166" is immersed in the deaerated liquid; and an opening section 220 provided at the position where the blade 166" is disposed.

The two blades (hard rubber) 210 are disposed substantially in parallel, leaving the gap 212 of 0.1 mm to 0.2 mm therebetween. The deaerated liquid fills into the gap 212 by means of capillary action and proceeds to spread throughout the whole gap 212.

Furthermore, a supply channel 222 and an outlet channel 224 are provided with the deaerated liquid accumulating container 214, in such a manner that a uniform volume of deaerated liquid is accumulated therein.

In a wiping action by means of a single blade, a phenomenon occurs whereby the volume of the liquid pool is not uniform; more specifically, the volume of the liquid pool in the central portion of the blade in the breadthwise direction (the direction substantially perpendicular to the wiping direction as indicated by the arrow in FIG. 16) is larger and the volume of the liquid pool at the end portions is smaller (the liquid volume is larger in the vicinity of the deaerated liquid supply nozzle 100, and the liquid volume decreases as the position becomes more distant from the deaerated liquid supply nozzle 100).

In a wiping process by using the blade 166" shown in FIG. 16, since a pool of the deaerated liquid is formed in the gap 212 between the two hard rubber members 210, then it is possible to form a uniform liquid pool throughout the breadthwise direction of the blade, by means of capillary action.

Adaptation Embodiment

Figure 17A:
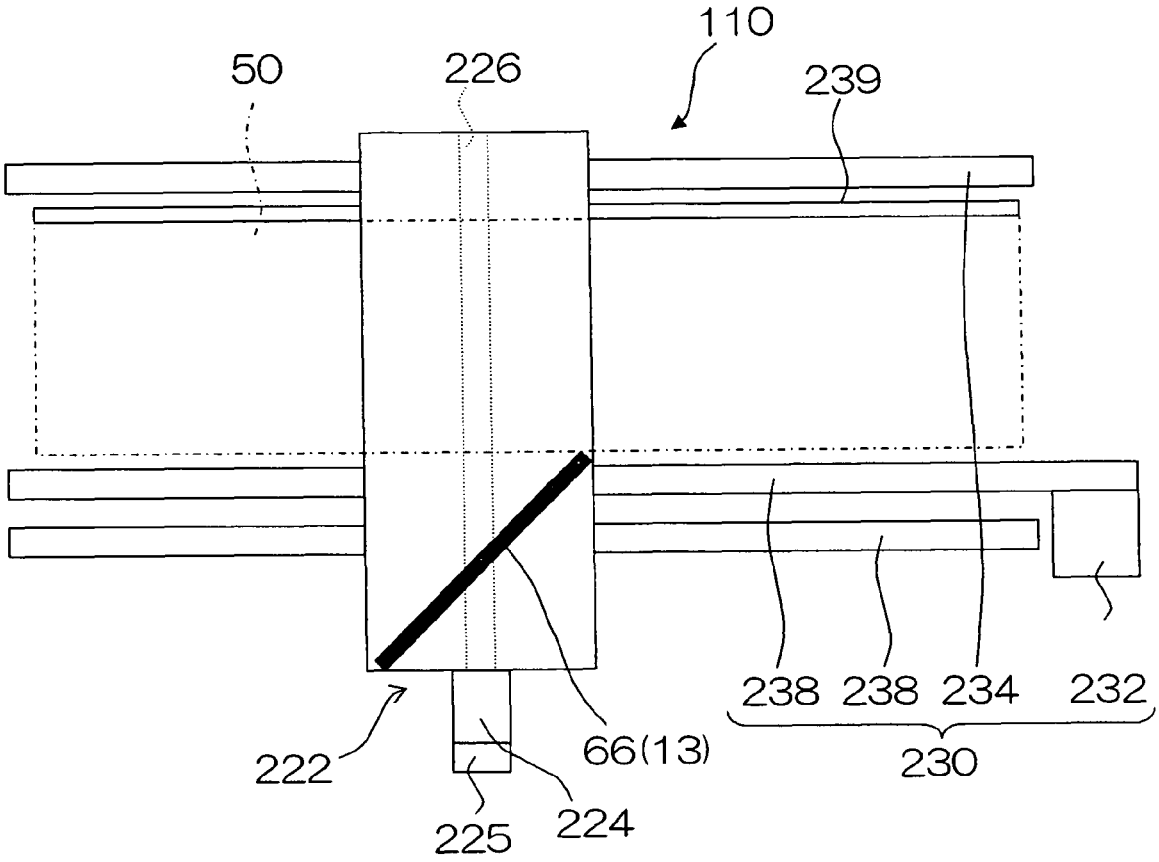
FIGS. 17A and 17B are conceptual diagrams showing the approximate composition of a blade movement mechanism relating to an adaptation embodiment of the present invention.

Next, an adaptation embodiment of the present invention is described below. FIG. 17A is an approximate schematic drawing of a wiping processing unit 13 and a wiping processing unit movement mechanism 110 according to the present adaptation embodiment. In the wiping processing unit 13 shown in FIG. 17A, an illustration of the members other than the blade 66, such as a deaerated liquid supply nozzle, is omitted.

The blade 66 according to the present adaptation embodiment is disposed in an oblique direction in which the breadthwise direction of the blade 66 forms an angle of $\alpha$ with respect to the breadthwise direction of the head 50. Furthermore, the blade 66 has a length which is capable of wiping a portion of the nozzle forming surface 51A (not shown in FIG. 17A) of the head 50 by means of one movement in the breadthwise direction, and it has a length which is capable of wiping the whole region in which the nozzles 51 are formed in the head 50 (the nozzle region, shown in FIG. 18B) by means of one movement in the longitudinal direction.

The wiping processing unit movement mechanism 110 includes: a breadthwise direction movement mechanism 222 which supports the blade 66 and moves the blade 66 in the breadthwise direction of the head 50; a lengthwise direction movement mechanism 230 which supports the breadthwise direction movement mechanism 222 and moves the blade 66 (and the breadthwise direction movement mechanism 222) in the lengthwise direction of the head 50; and a linear encoder 239 which determines the position of the blade 66 (the position in terms of the lengthwise direction of the head 50 in FIG. 17A). Moreover, a position determination device (rotary encoder) 225 which determines the position of the blade 66 in terms of the breadthwise direction of the head 50 is also provided. A linear encoder or a positional determination sensor, or the like, can be used for this position determination device 225.

If a serial system is being used, then the lengthwise direction movement mechanism 230 in FIG. 17A can be combined with the main scanning direction scanning mechanism of the head (the lengthwise direction movement mechanism 230 can be omitted).

The breadthwise direction movement mechanism 222 comprises a motor 224 forming a drive source, and a ball screw (direct acting type mechanism) 226 which causes the blade 66 to move in the breadthwise direction of the head 50 in accordance with the rotation of the motor 224. Furthermore, the lengthwise direction movement mechanism 230 includes guides 232, 234 which support the breadthwise direction movement mechanism 222, and a belt conveyance mechanism 238 which moves the blade 66 (breadthwise direction movement mechanism 222) in the lengthwise direction of the head 50, in accordance with the rotation of the motor 236.

As shown in FIG. 17A, by using the blade 66 disposed in an oblique direction which is not perpendicular to both the breadthwise direction and the lengthwise direction of the head 50, it is possible to carry out a wiping process in either a direction substantially parallel to the breadthwise direction of the head 50 or a direction substantially parallel to the lengthwise direction of the head 50.

Figure 17B:
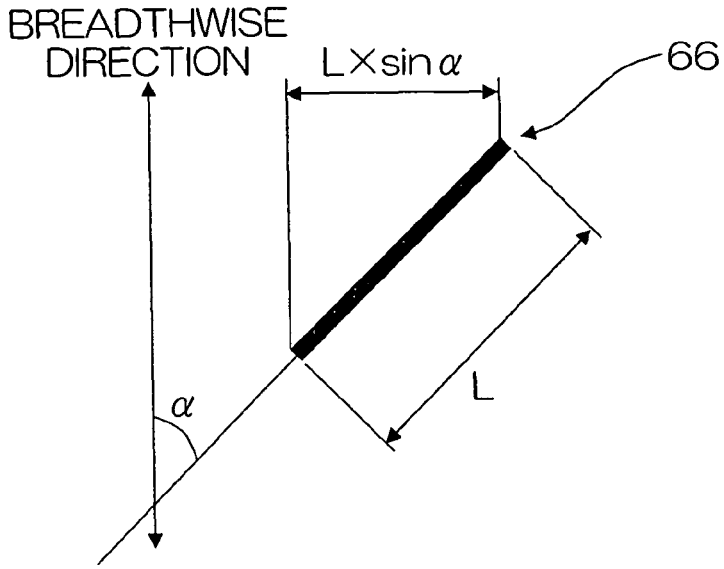

FIG. 17B is a diagram which describes the wiping region of the blade 66. If wiping is performed by following the breadthwise direction of the head 50, then the length of the wiping region (effective length of blade 66) when the blade 66 is moved once in the breadthwise direction of the head 50 can be expressed as "$L \times \sin \alpha$", where L is the width of the blade 66 and $\alpha$ is the angle formed between the blade 66 and the breadthwise direction of the head 50. By making this effective length of the blade 66 shorter than the length of the head 50 in the breadthwise direction, it is possible to set a narrow region for carrying out a wiping process of the nozzle forming surface 51A of the head 50 (for example, a plurality of regions for carrying out a wiping process of the nozzle forming surface 51A of the head 50 can be set with respect to the nozzle forming surface 51A).

Figure 18A:
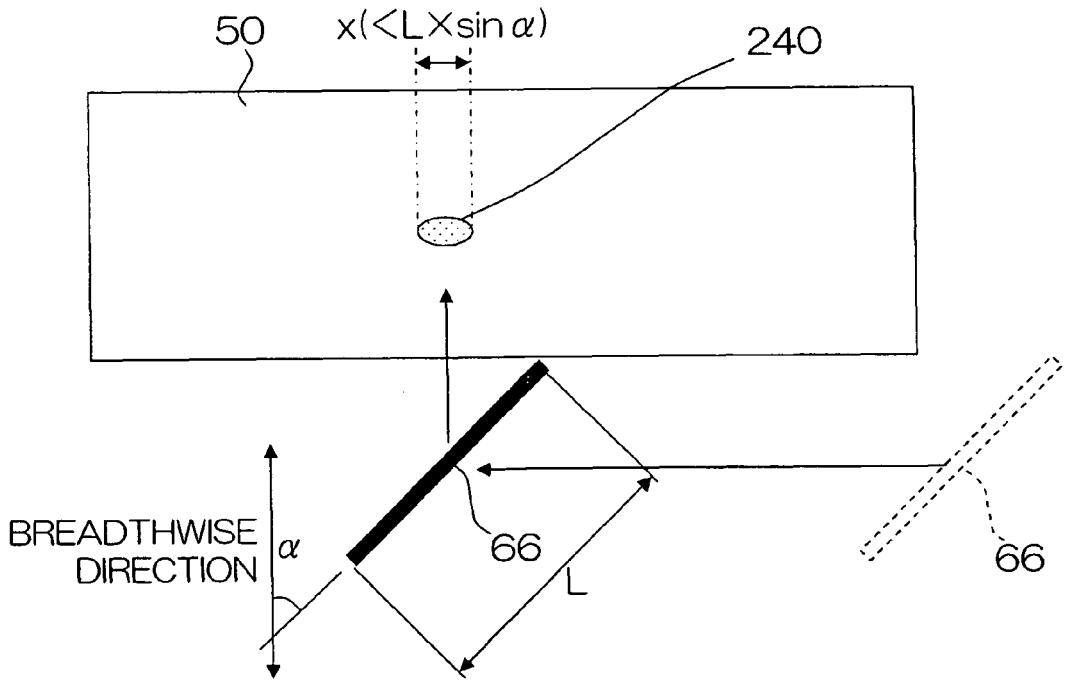
FIGS. 18A and 18B are conceptual diagrams for illustrating control for switching the wiping direction.
Figure 18B:
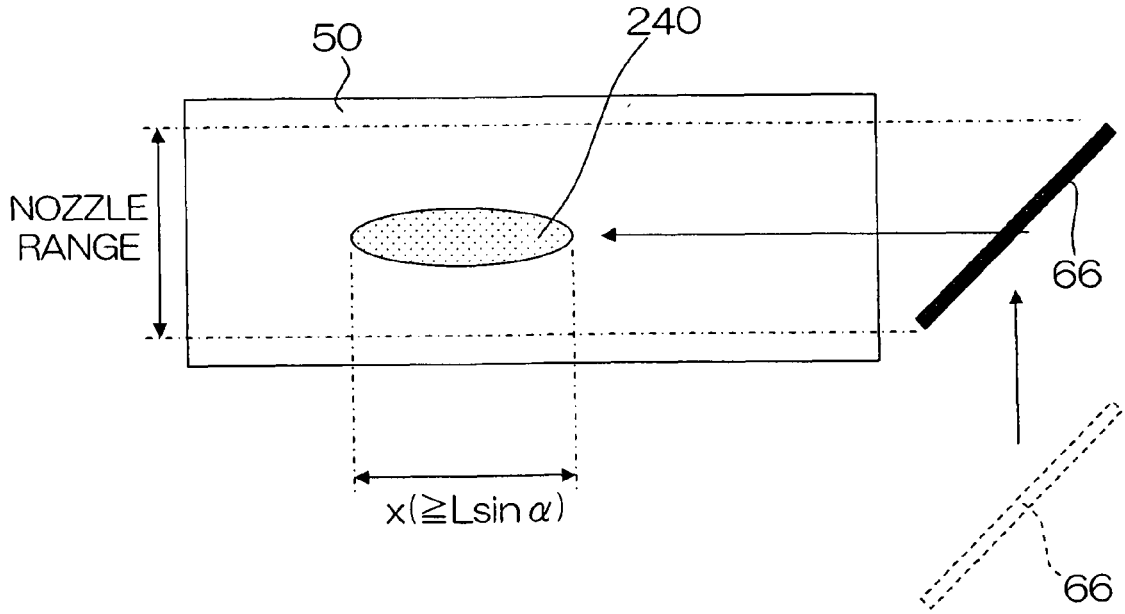

As shown in FIGS. 18A and 18B, in the wiping process control according to the present adaptation embodiment, if the length x of the region 240 for wiping in the lengthwise direction of the head 50 is less than the effective length of the blade 66, then a wiping process in which the blade 66 is moved in the breadthwise direction of the head 50 (breadthwise direction wiping) is carried out (see FIG. 18A). If the length x of the region 240 for wiping in the lengthwise direction of the head 50 is equal to or greater than the effective length of the blade 66, then a wiping process in which the blade 66 is moved in the lengthwise direction of the head 50 (lengthwise direction wiping) is carried out (see FIG. 18B).

In other words, as shown in FIG. 18A, if the relationship between the effective length ($L \times \sin \alpha$) of the blade 66 and the length x, in the lengthwise direction of the head 50, of the region 240 where ejection abnormality nozzles have been discovered (namely, the region for wiping), satisfies "$x < L \times \sin \alpha$", then the blade 66 is moved from the withdrawal position of the head 50 (as indicated by the broken line in FIG. 18A), in a substantially parallel direction to the lengthwise direction of the head 50, and is halted at the wiping start position which corresponds to the region 240 for wiping. When the blade 66 is subsequently moved in a substantially parallel direction to the breadthwise direction of the head 50 while abutting against the nozzle forming surface of the head 50, a wiping process of the nozzle forming surface of the head 50 is performed.

If, on the other hand, the relationship between the effective length ($L \times \sin \alpha$) of the blade 66 and the length x, in the lengthwise direction of the head 50, of the region 240 where ejection abnormality nozzles have been discovered (namely, the region for wiping), satisfies "$x \geqq L \times \sin \alpha$", as shown in FIG. 18B, then the blade 66 is moved from the withdrawal position (as indicated by the broken lines in FIG. 18B), in a substantially parallel direction to the breadthwise direction of the head 50, and is halted at the wiping start position which corresponds to the region 240 for wiping. When the blade 66 is subsequently moved once in a substantially parallel direction to the lengthwise direction of the head 50 while abutting against the nozzle forming surface of the head 50, a wiping process of the nozzle region of the nozzle forming surface of the head 50 is performed.

As the angle $\alpha$ formed between the blade 66 and the breadthwise direction of the head 50 becomes larger, so the range (the effective processing width) that can be processed by one wiping action in the breadthwise direction becomes larger; and as the angle $\alpha$ becomes smaller, so the range that can be processed by one wiping action in the lengthwise direction becomes larger. If "$\alpha = 45°$" is satisfied, then the range processed by one wiping action in the breadthwise direction and the range processed by one wiping action in the lengthwise direction become substantially equal. A desirable mode is one in which the blade 66 is disposed in such a manner that the angle $\alpha$ formed between the blade 66 and the breadthwise direction of the head 50 satisfies "$30° \leqq \alpha \leqq 60°$".

Figure 19:
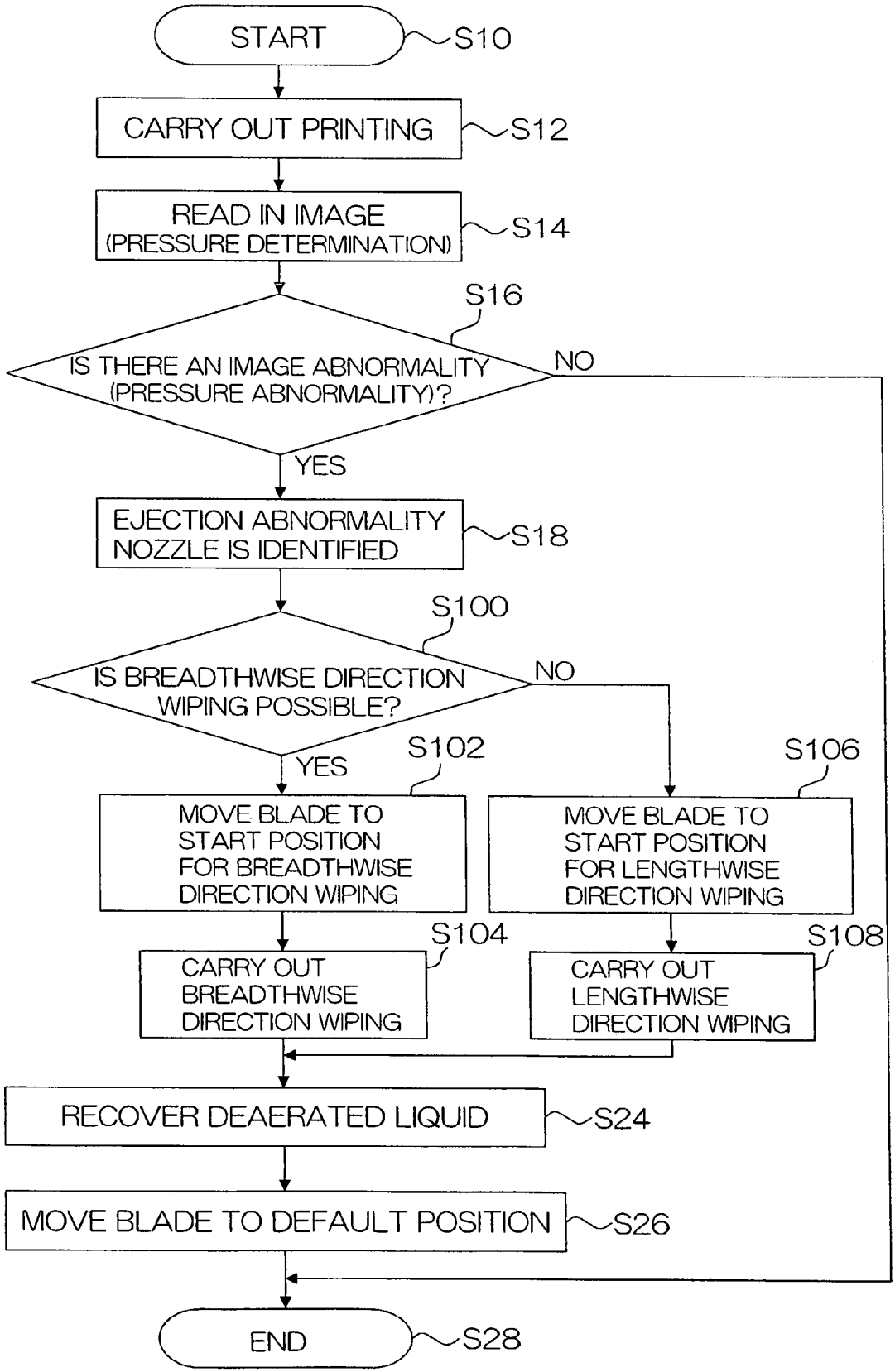
FIG. 19 is a flowchart showing a sequence of the wiping direction switching control shown in FIGS. 18A and 18B.

FIG. 19 is a flowchart showing the sequence of control of a wiping process in which the wiping process direction (the movement direction of the blade 66 in the wiping process) is switched selectively. In FIG. 19, items which are the same as or similar to those in FIG. 13 are labeled with the same reference numerals and description thereof is omitted here.

In the wiping process control shown in FIG. 19, if an ejection abnormality nozzle is identified (step S18), then it is judged whether or not a breadthwise direction wiping process is possible (step S100).

In other words, at step S100, the length, in the breadthwise direction of the head 50, of the region where ejection abnormality nozzles have been discovered is compared with the effective length of the blade 66. If the length, in the breadthwise direction of the head 50, of the region where the ejection abnormality nozzles have been discovered is less than the effective length of the blade 66 (i.e., the length, in the breadthwise direction of the head 50, of the region where the ejection abnormality nozzles have been discovered<the effective length of the blade 66) (YES verdict), then it is judged that the breadthwise direction wiping shown in FIG. 18A is possible, and hence the blade 66 is moved to the start position for breadthwise direction wiping (see FIG. 18A) (step S102 in FIG. 19), and breadthwise direction wiping is carried out (step S104).

When the breadthwise direction wiping has been completed at step S104 (in other words, when the blade 66 has passed through the region in which ejection abnormality nozzles occur), the blade 66 is halted, and deaerated liquid remaining on the nozzle forming surface of the head 50 is recovered (step S24). Thereupon, the blade 66 is moved to the withdrawal position (see FIG. 18A) (step S26 in FIG. 19), and the wiping process terminates (step S28).

On the other hand, if it is judged at step S100 that the breadthwise direction wiping cannot be carried out (NO verdict), then the blade 66 is moved to the start position for the lengthwise direction wiping (see FIG. 18B) (step S106 in FIG. 19), and the lengthwise direction wiping shown in FIG. 18B is carried out (step S108 in FIG. 19).

When the lengthwise direction wiping has been completed in step S108, the deaerated liquid remaining on the nozzle forming surface of the head 50 is recovered (step S24). Thereupon, the blade 66 is moved to the withdrawal position (see FIG. 18B) (step S26 in FIG. 19), and the wiping process terminates (step S28).

Based on the wiping control described above, it is possible to carry out a wiping process in the shortest time, according to the range in which ejection abnormality nozzles are situated. Therefore, improvements in the print processing speed can be expected.

The embodiments described above relates to a mode where the piezoelectric actuators 58 are used as devices for applying ejection force in order to eject ink droplets from the nozzles 51; however, the present invention may also be applied to a thermal method in which ink in the pressure chambers 52 is ejected by heating the ink inside the pressure chambers 52 and generating bubbles in the ink.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus comprising:

a liquid ejection head having a nozzle forming surface formed with nozzles from which a first liquid is ejected;

a wiping processing device which carries out a wiping process of the nozzle forming surface of the liquid ejection head; and a movement device which causes relative movement between the liquid ejection head and the wiping processing device, wherein the wiping processing device includes: a wiping member which wipes the nozzle forming surface of the liquid ejection head; and a liquid supply device which supplies a second liquid which has undergone a deaeration process, to a vicinity of a contact region between the wiping member and the nozzle forming surface of the liquid ejection head, on a side of forward travel of the wiping member, in the wiping process.

2. The liquid ejection apparatus as defined in claim 1, further comprising:

a recovery device which recovers the second liquid which has been supplied to the vicinity of the contact region between the wiping member and the nozzle forming surface;

a deaeration device which carries out a deaeration process of the second liquid which has been recovered by the recovery device; and a liquid feeding device which sends the second liquid which has undergone the deaeration process by the deaeration device, to the liquid supply device.

3. The liquid ejection apparatus as defined in claim 1, further comprising:

pressure chambers which are connected to the nozzles and accommodate the first liquid that is to be ejected from the nozzles;

pressurization devices which pressurize the first liquid in the pressure chambers;

a drive signal application device which applies drive signals to the pressurization devices; and a control device which controls the drive signal application device in the wiping process so as to apply the drive signals to the pressurization devices, in such a manner that the first liquid in the pressure chambers is pressurized by the pressurization devices so as not to eject the first liquid from the nozzles.

4. The liquid ejection apparatus as defined in claim 1, further comprising:

a position determination device which determines a position of the wiping processing device;

an ejection abnormality nozzle determination device which determines, of the nozzles, a nozzle suffering an ejection abnormality; and a control device which controls the wiping processing device and the movement device in such a manner that the wiping process is carried out by the wiping processing device with respect to the nozzle suffering the ejection abnormality determined by the ejection abnormality nozzle determination device.

5. The liquid ejection apparatus as defined in claim 1, wherein an amount of a dissolved gas in the second liquid is less than an amount of a dissolved gas in the first liquid.

6. The liquid ejection apparatus as defined in claim 1, wherein an amount of a dissolved gas in the second liquid is not more than 0.2 mg/l.

7. A liquid ejection apparatus comprising:

a liquid ejection head having a nozzle forming surface formed with nozzles from which a first liquid is ejected;

a wiping processing device which carries out a wiping process of the nozzle forming surface of the liquid ejection head; and a movement device which causes relative movement between the liquid ejection head and the wiping processing device, wherein the wiping processing device includes: a wiping member which wipes the nozzle forming surface of the liquid ejection head; and a liquid supply device which supplies a second liquid which has undergone a deaeration process, to a vicinity of a contact region between the wiping member and the nozzle forming surface of the liquid ejection head, on a side of forward travel of the wiping member, in the wiping process, wherein the wiping member has a structure in which the second liquid is supplied to the nozzle forming surface of the liquid ejection head.

8. A liquid ejection apparatus comprising:

a liquid ejection head having a nozzle forming surface formed with nozzles from which a first liquid is ejected;

a wiping processing device which carries out a wiping process of the nozzle forming surface of the liquid ejection head; and a movement device which causes relative movement between the liquid ejection head and the wiping processing device, wherein the wiping processing device includes: a wiping member which wipes the nozzle forming surface of the liquid ejection head; and a liquid supply device which supplies a second liquid which has undergone a deaeration process, to a vicinity of a contact region between the wiping member and the nozzle forming surface of the liquid ejection head, on a side of forward travel of the wiping member, in the wiping process, wherein the wiping member includes a regulation member which regulates a volume of the second liquid supplied to the vicinity of the contact region between the wiping member and the nozzle forming surface.

9. A liquid ejection apparatus comprising:

a liquid ejection head having a nozzle forming surface formed with nozzles from which a first liquid is ejected;

a wiping processing device which carries out a wiping process of the nozzle forming surface of the liquid ejection head;

a movement device which causes relative movement between the liquid ejection head and the wiping processing device;

a position determination device which determines a position of the wiping processing device;

an ejection abnormality nozzle determination device which determines, of the nozzles, a nozzle suffering an ejection abnormality; and a control device which controls the wiping processing device and the movement device in such a manner that the wiping process is carried out by the wiping processing device with respect to the nozzle suffering the ejection abnormality determined by the ejection abnormality nozzle determination device, wherein the wiping processing device includes: a wiping member which wipes the nozzle forming surface of the liquid ejection head; and a liquid supply device which supplies a second liquid which has undergone a deaeration process, to a vicinity of a contact region between the wiping member and the nozzle forming surface of the liquid ejection head, on a side of forward travel of the wiping member, in the wiping process, wherein;

the liquid ejection head is a line head which corresponds to a width of an ejection receiving medium which receives the first liquid ejected from the liquid ejection head;

the wiping member is disposed in an oblique direction forming an angle of a (where $0° < \alpha < 90°$) with respect to a breadthwise direction of the liquid ejection head, in the wiping process;

the movement device is capable of switching a direction of the relative movement between the liquid ejection head and the wiping processing device, between the breadthwise direction of the liquid ejection head and a lengthwise direction of the liquid ejection head; and the control device controls the wiping processing device and the movement device in such a manner that the direction of the relative movement between the liquid ejection head and the wiping processing device is selectively switched.

10. A maintenance method for a liquid ejection head having a nozzle forming surface formed with nozzles from which a first liquid is ejected, the maintenance method including the steps of:

disposing a wiping processing device including a wiping member, at a prescribed position; and causing relative movement between the liquid ejection head and the wiping processing device in such a manner that a wiping process in which the wiping member wipes the nozzle forming surface of the liquid ejection head is carried out, while a second liquid which has undergone a deaeration process is supplied to a vicinity of a contact region between the wiping member and the nozzle forming surface of the liquid ejection head.

* * * * *